US010006457B2

(12) United States Patent
Watanabe et al.

(10) Patent No.: US 10,006,457 B2
(45) Date of Patent: Jun. 26, 2018

(54) VARIABLE DISPLACEMENT PUMP

(71) Applicant: HITACHI AUTOMOTIVE SYSTEMS, LTD., Hitachinaka-shi, Ibaraki (JP)

(72) Inventors: Yasushi Watanabe, Kanagawa (JP); Atsushi Naganuma, Atsugi (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 0 days. days.

(21) Appl. No.: 15/584,283

(22) Filed: May 2, 2017

(65) Prior Publication Data

US 2017/0234311 A1 Aug. 17, 2017

Related U.S. Application Data

(62) Division of application No. 13/974,686, filed on Aug. 23, 2013, now Pat. No. 9,670,925.

(30) Foreign Application Priority Data

Sep. 7, 2012 (JP) ..... 2012-196713

(51) Int. Cl.
*F04C 14/22* (2006.01)
*F04C 2/344* (2006.01)
(Continued)

(52) U.S. Cl.
CPC ..... *F04C 14/226* (2013.01); *F04B 49/002* (2013.01); *F04C 2/3442* (2013.01); *F04B 17/05* (2013.01)

(58) Field of Classification Search
CPC ..... F04C 14/226; F04C 14/12; F04C 14/18; F04C 14/22; F04C 14/223; F04C 2/344;
(Continued)

(56) References Cited

U.S. PATENT DOCUMENTS 3,924,969 A * 12/1975 Rometsch ..... F04B 49/08 417/218
5,518,380 A 5/1996 Fujii et al.
(Continued)

FOREIGN PATENT DOCUMENTS

EP 2 253 847 A1 11/2010
JP 59-070891 A 4/1984
(Continued)

OTHER PUBLICATIONS

Watanabe et al.: U.S. Corrected Notice of Allowability on U.S. Appl. No. 14/923,715 dated Nov. 3, 2017.
(Continued)

*Primary Examiner* — Bryan Lettman
*Assistant Examiner* — Timothy Solak
(74) *Attorney, Agent, or Firm* — Foley & Lardner LLP

(57) ABSTRACT

A variable displacement pump includes: an urging mechanism which includes two spring members; an electromagnetic switching valve which is arranged to connect the second control chamber and the discharge portion in an energized state, and to connect the second control chamber and the low pressure chamber in a deenergized state; and a control valve which is actuated by the pressure of the discharge portion, and which is arranged to decrease the pressure within the second control chamber when the pressure of the discharge portion becomes equal to or greater than a predetermined pressure.

2 Claims, 11 Drawing Sheets

(51) Int. Cl.
*F04B 17/05* (2006.01)
*F02B 49/00* (2006.01)
*F04B 49/00* (2006.01)

(58) Field of Classification Search
CPC .. F04C 2/3442; F04C 2/38; F04C 2/40; F04C 2/44; F04C 2210/206; F04C 29/0021; F04C 2240/811; F04C 28/18; F04C 28/22; F04C 2270/07; F04C 2270/075; F04C 2270/18; F04C 2270/20
See application file for complete search history.

(56) References Cited

U.S. PATENT DOCUMENTS

| | | | | |
|---|---|---|---|---|
| 6,530,752 | B2 | 3/2003 | Oba et al. | |
| 6,672,844 | B2 | 1/2004 | Fukanuma et al. | |
| 7,794,217 | B2 | 9/2010 | Williamson et al. | |
| 8,317,486 | B2 | 11/2012 | Williamson et al. | |
| 8,684,702 | B2 | 4/2014 | Watanabe et al. | |
| 8,690,544 | B2 | 4/2014 | Ono et al. | |
| 9,109,596 | B2 | 8/2015 | Ohnishi et al. | |
| 9,410,514 | B2 | 8/2016 | Watanabe | |
| 9,494,152 | B2 | 11/2016 | Saga | |
| 9,494,153 | B2 | 11/2016 | Watanabe et al. | |
| 9,670,925 | B2 | 6/2017 | Watanabe et al. | |
| 9,670,926 | B2 | 6/2017 | Ohnishi et al. | |
| 2008/0308062 | A1 | 12/2008 | Morita et al. | |
| 2009/0022612 | A1 | 1/2009 | Williamson et al. | |
| 2009/0291000 | A1* | 11/2009 | Saga | F04C 2/3442 417/364 |
| 2010/0028171 | A1* | 2/2010 | Shulver | F01M 1/16 417/307 |
| 2010/0205952 | A1 | 8/2010 | Yamamuro et al. | |
| 2010/0329912 | A1 | 12/2010 | Williamson et al. | |
| 2011/0085921 | A1* | 4/2011 | Kato | 417/213 |
| 2011/0123379 | A1 | 5/2011 | Saga et al. | |
| 2011/0194967 | A1 | 8/2011 | Watanabe et al. | |
| 2012/0213655 | A1 | 8/2012 | Ohnishi et al. | |
| 2013/0089446 | A1 | 4/2013 | Williamson et al. | |
| 2013/0164162 | A1 | 6/2013 | Saga | |
| 2013/0164163 | A1 | 6/2013 | Ohnishi et al. | |
| 2014/0072456 | A1 | 3/2014 | Watanabe et al. | |
| 2014/0072458 | A1 | 3/2014 | Watanabe | |
| 2014/0119969 | A1 | 5/2014 | Iijima | |
| 2014/0147322 | A1 | 5/2014 | Saga | |
| 2014/0219847 | A1 | 8/2014 | Watanabe et al. | |
| 2015/0020759 | A1 | 1/2015 | Watanabe et al. | |
| 2015/0218983 | A1 | 8/2015 | Watanabe et al. | |
| 2016/0090983 | A1 | 3/2016 | Miyajima et al. | |
| 2016/0153325 | A1 | 6/2016 | Saga | |
| 2016/0177950 | A1 | 6/2016 | Watanabe et al. | |
| 2017/0184096 | A1 | 6/2017 | Tanasuca et al. | |

FOREIGN PATENT DOCUMENTS

| | | | |
|---|---|---|---|
| JP | 2004-218529 | A | 8/2004 |
| JP | 2008-524500 | A | 7/2008 |
| JP | 2011-080430 | A | 4/2011 |
| JP | 2011-111926 | A | 6/2011 |
| JP | 2013-130090 | A | 7/2013 |
| JP | 2014-105623 | A | 6/2014 |
| WO | WO-2012/113437 | A1 | 8/2012 |

OTHER PUBLICATIONS

Watanabe et al.: U.S. Notice of Allowance on U.S. Appl. No. 14/923,715 dated Oct. 18, 2017.
Saga: Non-Final U.S. Office Action on U.S. Appl. No. 15/290,394 dated Aug. 10, 2017.
Watanabe et al.: Non-Final U.S. Office Action on U.S. Appl. No. 14/923,715 dated May 16, 2017.
U.S. Appl. No. 15/290,394, filed Oct. 11, 2016, Saga et al.
Saga: Non-Final Office Action dated Aug. 14, 2015 issued in corresponding U.S. Appl. No. 14/073,347.
Watanabe et al.: Non-Final Office Action dated Aug. 28, 2015 issued in corresponding U.S. Appl. No. 13/852,636.
Watanabe et al.: Non-Final Office Action dated Aug. 31, 2015 issued in corresponding U.S. Appl. No. 14/073,357.
Watanabe et al.: U.S. Notice of Allowance on U.S. Appl. No. 13/852,636 dated Mar. 24, 2016.
Watanabe et al.: U.S. Office Action on U.S. Appl. No. 13/974,686 dated Mar. 24, 2016.
Saga: U.S. Office Action on U.S. Appl. No. 14/073,347 dated Apr. 8, 2016.
Watanabe et al.: U.S. Notice of Allowance on U.S. Appl. No. 14/073,357 dated Jun. 29, 2016.
Saga: U.S. Notice of Allowance on U.S. Appl. No. 14/073,347 dated Jul. 21, 2016.
Watanabe et al.: U.S. Notice of Allowance on U.S. Appl. No. 13/974,686 dated Feb. 1, 2017.
Saga: U.S. Office Action on U.S. Appl. No. 14/884,310 dated Jan. 25, 2018.
Saga: U.S. Office Action on U.S. Appl. No. 15/290,394 dated Feb. 5, 2018.
Saga: U.S. Notice of Allowance on U.S. Appl. No. 15/290,394 dated May 2, 2018.

* cited by examiner

VARIABLE DISPLACEMENT PUMP

CROSS-REFERENCE TO RELATED APPLICATIONS

The present application is a divisional application of U.S. application Ser. No. 13/974,686, filed Aug. 23, 2013, which claims the benefit of priority from Japanese Patent Application No. 2012-196713, filed Sep. 7, 2012; the entire contents of all of which are incorporated herein by reference.

BACKGROUND OF THE INVENTION

This invention relates to a variable displacement pump arranged to supply oil to sliding portions of an internal combustion engine for a vehicle and so on.

In recent years, an oil discharged from an oil pump is used for a driving source of a variable valve actuating device, an oil jet arranged to cool a piston, and a lubrication of a bearing of a crank shaft. The driving source of the variable valve actuating device, the oil jet, and the lubrication of the bearing of the cranks shaft have different desired discharge pressures. Accordingly, there are demands that a low pressure characteristic and a high pressure characteristic are switched in a low engine speed region, and that the high pressure characteristic is obtained in the high engine speed region. Patent Document 1, Japanese Patent Application Publication No. 2008-524500 (corresponding to U.S. Patent Application Publication No. 2009/0022612, U.S. Patent Application Publication No. 2010/0329912, and U.S. Patent Application Publication No. 2013/0089446), and Patent Document 2, Japanese Patent Application Publication No. 2011-111926 (corresponding to U.S. Patent Application Publication No. 2011/0123379) disclose variable displacement pump for satisfying the above-described demands.

The variable displacement pump of Japanese Patent Application Publication No. 2008-524500 includes a cam ring which is arranged to be swung against an urging force of a spring to vary an eccentric amount with respect to a rotor, and two pressure receiving chambers disposed radially outside the cam ring. The variable displacement pump of Japanese Patent Application Publication No. 2008-524500 is arranged to selectively act the pump discharge pressure to the two pressure receiving chambers by an electric control device such as an electromagnetic valve, and thereby to freely select different characteristics of the low pressure characteristic and the high pressure characteristic.

In the variable displacement pump of Japanese Patent Application Publication No. 2011-111926, the cam ring is urged by two spring members which have, respectively, different spring loads. With this, it is possible to mechanically obtain the low pressure characteristic and the high pressure characteristic without using the electric control device.

SUMMARY OF THE INVENTION

However, in the variable displacement pump of Japanese Patent Application Publication No. 2008-524500, in a case in which it is considered that the electromagnetic valve is failed, it is necessary that the oil pump is in the high pressure characteristic in a deenergization state of the electromagnetic valve. Conversely, for obtaining the low pressure characteristic in the low engine speed region that is a desired characteristic in the normal driving state, it is necessary to constantly continue the energization state of the electromagnetic valve. Therefore, the loss of the electric energy may be large.

Moreover, in the variable displacement pump of Japanese Patent Application Publication No. 2011-111926, the electric energy is not used. However, it is not possible to obtain the high pressure characteristic in the low engine speed region although the low pressure characteristic can be obtained in the low engine speed region.

It is, therefore, an object of the present invention to provide a variable displacement pump devised to solve the above mentioned problems, and to decrease an electric energy loss for switching between a low pressure characteristic and a high pressure characteristic in a low engine speed region, and for obtaining the high pressure characteristic in a high engine speed region.

According to one aspect of the present invention, a variable displacement pump arranged to supply an oil to at least a hydraulic variable valve actuating system, an oil jet, and a bearing of a crank shaft which are used in an internal combustion engine, the variable displacement pump comprises: a rotor driven by the internal combustion engine; a plurality of vanes which are provided on an outer circumference portion of the rotor to be projectable from and retractable in the rotor; a cam ring which receives the rotor and the vanes radially therein, which separates a plurality of hydraulic fluid chambers therein, and which is arranged to be moved to vary an eccentric amount of the cam ring with respect to a center of the rotation of the rotor; a suction portion opened in the hydraulic fluid chambers whose volumes are increased when the cam ring is moved in one direction to be eccentric with respect to the center of the rotation of the rotor; a discharge portion opened in the hydraulic chambers whose volumes are decreased when the cam ring is moved in the other direction to be eccentric with respect to the center of the rotation of the rotor; an urging mechanism which includes two spring members disposed in a state in which the two spring members are provided, respectively, with spring loads, which applies an urging force in a movement direction of the cam ring to the cam ring by a relative spring force of the two spring members, and which is arranged to stepwisely increase the urging force in the eccentric direction of the cam ring by one of the spring members when the cam ring is moved in the other direction from a maximum eccentric movement position in the one direction so that the eccentric amount becomes equal to or smaller than a predetermined amount; a first control chamber which is arranged to receive an oil discharged from the discharge portion, and thereby to act a force in a direction in which the eccentric amount of the cam ring with respect to the center of the rotation of the rotor is decreased, to the cam ring; a second control chamber which is arranged to receive the oil discharged from the discharge portion, and thereby to act a force in a direction in which the eccentric amount of the cam ring with respect to the center of the rotation of the rotor is increased, to the cam ring, the force by the second control chamber being smaller than the force by the first control chamber; an electromagnetic switching valve which is arranged to connect the second control chamber and the discharge portion in an energized state, and to connect the second control chamber and the low pressure chamber in a deenergized state; and a control valve which is actuated by the pressure of the discharge portion, and which is arranged to decrease the pressure within the second control chamber when the pressure of the discharge portion becomes equal to or greater than a predetermined pressure.

According to another aspect of the invention, a variable displacement pump arranged to supply an oil to a hydraulic variable valve actuating device, an oil jet and a bearing of a crank shaft which are used in an internal combustion engine, the variable displacement pump comprises: a pump constituting section arranged to vary volumes of a plurality of hydraulic fluid chambers by being driven by the internal combustion engine, and thereby to discharge the oil sucked from a suction portion, from a discharge portion; a variable mechanism arranged to move a movable member, and thereby to vary variation amounts of the volumes of the hydraulic fluid chambers which are opened to the discharge portion; an urging mechanism which includes two spring members disposed in a state in which the two spring members have spring loads respectively, which applies, to the movable member by a relative spring force of the two spring members, an urging force to vary the variation amounts of the volumes of the hydraulic fluid chambers which are opened to the discharge portion, and to stepwisely increase the urging force by the one of the spring members when the variation amount of the movable member becomes equal to or smaller than a predetermined amount, from the maximum variation amount of the volumes of the hydraulic fluid chambers: a first control chamber which is arranged to receive the oil discharged from the discharge portion, and thereby to apply, to the cam ring, a force in a direction in which the variation amounts of the volumes of the hydraulic fluid chambers which are opened to the discharge portion become small; a second control chamber which is arranged to receive the oil discharged from the discharge portion, and thereby to apply, to the cam ring, a force in a direction in which the variation amounts of the volumes of the hydraulic fluid chambers which are opened to the discharge portion becomes large, the force by the second control chamber being smaller than the force by the first control chamber; an electromagnetic switching valve which is arranged to connect the second control chamber and the discharge portion in an energized state, and to connect the second control chamber and the low pressure chamber in a deenergized state; and a control valve which is actuated by the pressure of the discharge portion, and which is arranged to decrease the pressure within the second control chamber when the pressure of the discharge portion becomes equal to or greater than a predetermined pressure.

According to still another aspect of the invention, a variable displacement pump arranged to supply an oil to a hydraulic variable valve actuating device, an oil jet, and a bearing of a crank shaft which are used in an internal combustion engine, the variable displacement pump comprises: a rotor driven by the internal combustion engine; a plurality of vanes which are provided on an outer circumference portion of the rotor to be projectable from and retractable in the rotor; a cam ring which receives the rotor and the vanes radially therein, which separates a plurality of hydraulic chambers therein, and which is arranged to be moved to vary an eccentric amount of a center of an inner circumference surface of the cam ring with respect to a center of the rotation of the rotor; a suction portion opened in the hydraulic fluid chambers whose volumes are increased when the center of the inner circumference surface of the cam ring is eccentrically moved in one direction with respect to a center of the rotation of the rotor; a discharge portion opened in the hydraulic fluid chambers whose volumes are decreased when the center of the inner circumference surface of the cam ring is eccentrically moved in the other direction with respect to the center of the rotation of the rotor; an urging mechanism which includes two spring members disposed in a state in which the two spring members are provided, respectively, with spring loads, which applies an urging force in a movement direction of the cam ring to the cam ring by a relative spring force of the two spring members, and which is arranged to stepwisely increase the urging force in the eccentric direction of the cam ring by one of the spring members when the cam ring is moved in the other direction from a maximum eccentric movement position in the one direction so that the eccentric amount becomes equal to or smaller than a predetermined amount; a first control chamber which is arranged to receive the oil discharged from the discharge portion, and thereby to act a force in a direction in which the eccentric amount between the center of the rotation of the rotor and the center of the inner circumference surface of the cam ring becomes small, to the cam ring; a second control chamber which is arranged to receive the oil discharged from the discharge portion, and thereby to act a force in a direction in which the eccentric amount between the center of the rotation of the rotor and the center of the inner circumference surface of the cam ring becomes large, to the cam ring; an electromagnetic switching valve arranged to connect the second control chamber and the low pressure portion in an energization state, and to connect the second control chamber and the discharge portion in a deenergization state; and a control valve which is arranged to be actuated by the pressure of the discharge portion, and which is arranged to introduce the pressure to the second control chamber and to decrease an area between the second control chamber and the low pressure portion when the pressure of the discharge portion becomes equal to or greater than a predetermined pressure.

According to still another aspect of the invention, a variable displacement pump arranged to supply an oil to at least a hydraulic variable valve actuating device, an oil jet, and a bearing of a crank shaft which are used in an internal combustion engine, the variable displacement pump comprises: a pump constituting section arranged to vary volumes of a plurality of hydraulic fluid chambers by being driven by the internal combustion engine, and thereby to discharge the oil sucked from a suction portion, from a discharge portion; a variable mechanism arranged to move a movable member, and thereby to vary variation amounts of the volumes of the hydraulic fluid chambers which are opened to the discharge portion; an urging mechanism which includes two spring members disposed in a state where the two spring members have, respectively, spring loads, which is arranged to urge the movable member in a direction in which the variation amounts of the volumes of the hydraulic fluid chambers that are opened to the discharge portion become large by an urging force generated by the two spring members, and which has the urging force stepwisely increasing when the variation amounts of the volumes of the hydraulic fluid chambers that are opened to the discharge portion become equal to or smaller than a predetermined amount; a first control chamber which is arranged to receive the oil discharged from the discharge portion, and thereby to apply, to the cam ring, a force in a direction in which the variation amounts of the volumes of the hydraulic fluid chambers that are opened to the discharge portion become smaller; a second control chamber which is arranged to receive the oil discharged from the discharge portion, and thereby to apply, to the cam ring, a force in a direction in which the variation amounts of the volumes of the hydraulic fluid chambers that are opened to the discharge portion become larger; an electromagnetic switching valve which is arranged to connect the second control chamber and the low pressure portion in an energized state, and to connect the second control chamber and the discharge portion in a deenergized state; and a control valve which is arranged to be actuated by the discharge pressure of the discharge portion, and which is arranged to receive the pressure of the second control chamber and to decrease an area of a connection between the second control chamber and the low pressure portion when the discharge pressure of the discharge portion becomes equal to or greater than a predetermined pressure.

DETAILED DESCRIPTION OF THE INVENTION

Hereinafter, a variable displacement pump according to a first embodiment of the present invention is illustrated in detail based on the drawings. Besides, the embodiments show that the present invention is applied to a variable displacement pump arranged to actuate (to serve as an operation source of) a variable valve actuating mechanism arranged to vary valve timings of an engine valve of an internal combustion engine for a vehicle, to supply a lubricating oil to sliding portions of the engine, in particular, to sliding portions between a piston and a cylinder bore by an oil jet, and to supply the lubricating oil to bearings of a crank shaft.

First Embodiment

Figure 1:
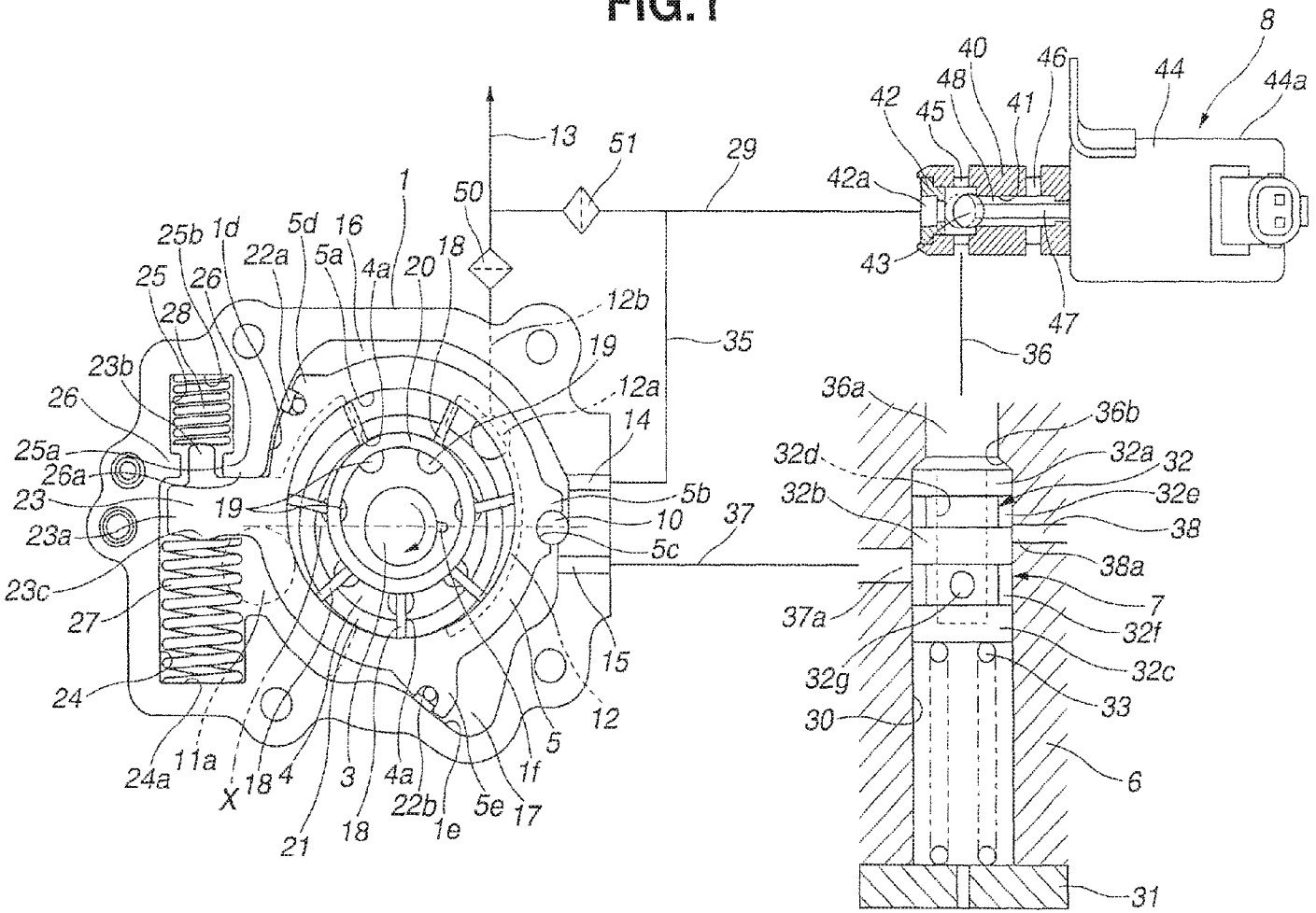
FIG. 1 is a schematic view showing a variable displacement pump according to a first embodiment of the present invention.
Figure 2:
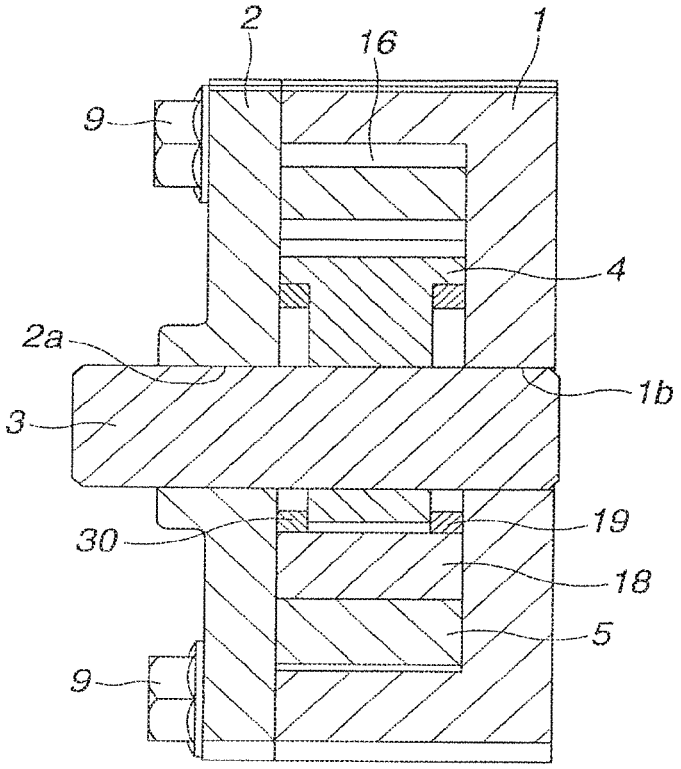
FIG. 2 is a longitudinal sectional view showing a pump body.

The variable displacement pump according to the first embodiment of the present invention includes a pump main body of a vane type. The variable displacement pump is provided to a front end portion of a cylinder block of an internal combustion engine. As shown in FIGS. 1 and 2, the variable displacement pump includes a pump housing 1 which includes one end opening that is closed by a pump cover 2, and the other bottomed end portion; a drive shaft 3 which penetrates through a substantially center portion of pump housing 1, and which is driven by the crank shaft of the engine; a rotor 4 which has a substantially H-shaped cross section, which is rotationally received within pump housing 1, and which includes a center portion connected with drive shaft 3; and a cam ring 5 which is a movable member that is swingably disposed radially outside rotor 4.

Moreover, the variable displacement pump includes a control housing 6 which is made from an aluminum alloy, and which is disposed and fixed on an outer surface of pump cover 2; a pilot valve 7 which is a control valve that is provided to control housing 6, and that is arranged to switch a supply and a discharge of a hydraulic pressure to and from a second control hydraulic chamber 17 (described later) for swinging cam ring 5; and an electromagnetic switching valve 8 which is a solenoid valve that is provided to a cylinder block (not shown), and that is arranged to control an operation of pilot valve 7.

As shown in FIG. 2, pump housing 1 and pump cover 2 are integrally joined with four bolts before pump housing 1 and pump cover 2 are mounted to the cylinder block. These bolts 9 are inserted through bolt insertion holes (not shown) which are formed in pump housing 1 and pump cover 2. Tip end portions of these bolts 9 are screwed into internal screw portions formed in the cylinder block.

Figure 3:
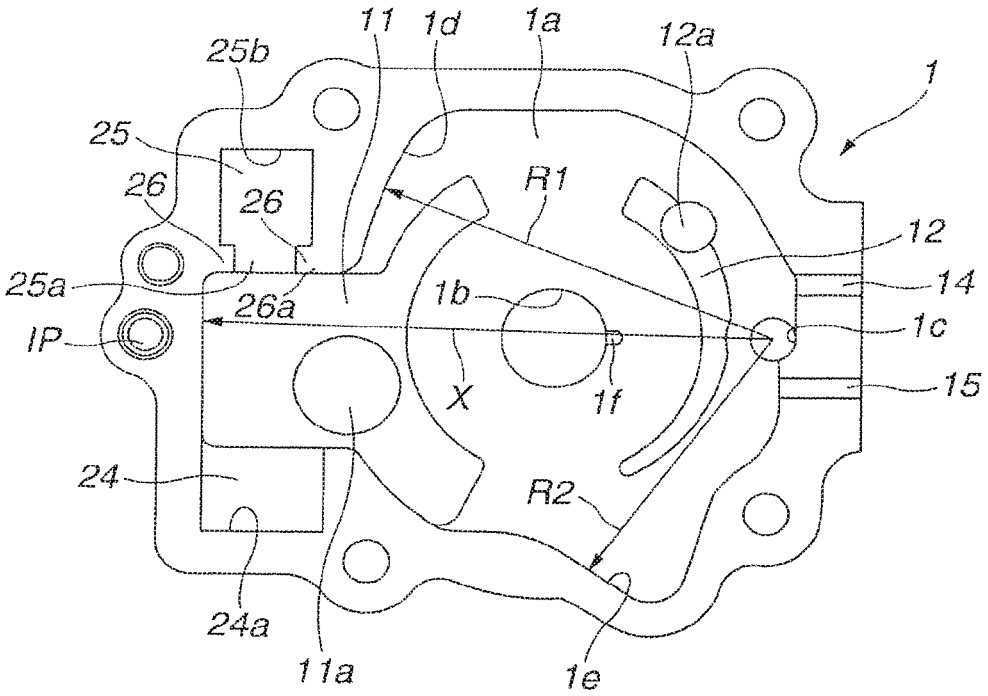
FIG. 3 is a front view showing a pump housing of the variable displacement pump of FIG. 1.

Pump housing 1 is integrally formed from aluminum alloy. As shown in FIG. 3, pump housing 1 includes a recessed bottom surface la on which one axial end surface of cam ring 5 is slid. Accordingly, recessed bottom surface la of pump housing 1 is formed to have a high accuracy of flatness and a high accuracy of surface roughness. A sliding region of bottom surface la on which cam ring 5 is slid is machined.

As shown in FIGS. 1 and 2, pump housing 1 includes a bearing hole 1*b* which is formed at a substantially central portion of pump housing 1, and which drive shaft 3 is penetrated through and supported on; a pin hole 1*c* which is formed into a bottomed shape, which is formed on an inner circumference surface of pump housing 1 at a predetermined position, and into which a pivot pin 10 is inserted; and a first seal surface 1*d* which is formed into an arc recessed shape, and which is formed on the inner circumference of pump housing 1 at a position vertically above a line X (hereinafter, referred to as a cam ring reference line) connecting a shaft center of pivot pin 10 and a center of pump housing 1 (a shaft center of drive shaft 3). Moreover, pump housing 1 includes a second seal surface 1*e* which is formed into an arc recessed shape, and which is formed on the inner circumference of pump housing 1 at a position vertically below cam ring reference line X.

A first seal member 22*a* is provided on an upper side of cam ring 5 in FIG. 1. First seal member 22*a* is slidably abutted on first seal surface ld so as to separate and seal a first control hydraulic chamber 16 (described later) which is a first control chamber, together with the outer circumference surface of cam ring 5.

Similarly, a second seal member 22*b* is provided on a lower side of cam ring 5 in FIG. 1. Second seal member 22*b* is slidably abutted on second seal surface le so as to separate and seal second control hydraulic chamber 17 (described later) which is a second control chamber, together with the outer circumference surface of cam ring 5.

As shown in FIG. 3, first and second seal surfaces 1*d* and 1*e* have, respectively, arc surfaces which are formed about a center of pin hole 1, and which have predetermined radii R1 and R2, respectively.

Moreover, pump housing 1 includes a suction port 11 which is formed into a substantially crescent shape, which is formed on bottom surface la of pump housing 1, and which is located on a left side of drive shaft 3; and a s discharge port 12 which is a discharge portion, which is formed into a substantially crescent shape, which is formed on bottom surface 1*a* of pump housing 1, and which is located on a right side of drive shaft 3. Suction port 11 and discharge port 12 are disposed to confront each other.

As shown in FIGS. 1 and 3, suction port 11 is connected to a suction opening 11*a* arranged to suck the lubricating oil within an oil pan (not shown). On the other hand, discharge port 12 is connected from a discharge opening 12*a* through an oil main gallery 13 to sliding portions of the engine, a variable valve actuating device such as a valve timing control device, and bearings of the crank shaft.

A branch passage 29 is bifurcated from a main oil gallery 13. Branch passage 29 is connected to electromagnetic switching valve 8 and pilot valve 7.

A first oil filter 50 is provided to a portion of main oil gallery 13 near a discharge passage 12*b*. A second oil filter 51 is provided to a portion of branch passage 29 near the bifurcated portion between main oil gallery 13 and branch passage 29. With this, the oil supplied to pilot valve 7 and electromagnetic switching valve 8 is doubly filtered by the two filters.

For example, filter papers are used as these oil filters 50 and 51. In a case where these oil filters 50 and 51 are clogged, it is possible to exchange by exchangeable filter paper of cartridge type.

Moreover, pump housing 1 includes a lubricating oil groove 1*f* which is formed on an inner circumference surface of bearing hole 1*b* of drive shaft 3 which is formed at the substantially central portion of bottom surface 1*a*, which holds the lubricating oil discharged from discharge port 12, and which is arranged to lubricate drive shaft 3.

Furthermore, pump housing 1 includes a first connection groove 14 and a second connection groove 15 which are formed, respectively, above and below pin hole 1*c* in FIG. 1, and which are connected, respectively, to first control hydraulic chamber 16 and second control hydraulic chamber 17.

Pump cover 2 is integrally formed from the aluminum alloy. As shown in FIG. 2, pump cover 2 includes an inner side surface which is formed into a flat shape. Moreover, pump cover 2 includes a bearing hole 2*a* which is formed at a substantially central position of pump cover 2, which penetrates through pump cover 2, and which supports drive shaft 3 together with bearing hole 1*b* of pump housing 1. In this case, the inner side surface of pump cover 2 is formed into the flat surface. However, the suction opening, the discharge opening, and an oil storing portion can be formed on the inner side surface of pump cover 2, similarly to the bottom surface 1*a* of pump housing 1. Moreover, this pump cover 2 is mounted to housing 1 by bolts while pump cover 2 is positioned to pump housing 1 in the circumferential direction by a plurality of positioning pins IP.

Drive shaft 3 is arranged to rotate rotor 4 in a clockwise direction in FIG. 1 by a rotational force s transmitted from the crank shaft. A left side half region of drive shaft 3 in FIG. 1 is a suction region, and a right side half region of drive shaft 3 in FIG. 1 is a discharge region.

As shown in FIG. 1, rotor 4 includes seven slits 4*a* which are formed to extend from an internal central side in the radially outward directions, and each of which a vane 18 is inserted to be moved; seven vanes 18 each of which is inserted to be moved into and out of (projectable from and retractable in) one of the seven slits 4*a;* and back pressure chambers 19 each of which is formed into a substantially circular section, each of which is formed at a base end portion of one of the slits 4*a,* and into which the discharge hydraulic pressure discharged to discharge port 12 is introduced.

Each of vanes 18 includes a base end which is located at a radially inside, and which is slidably abutted on an outer circumference surface of a pair of vane rings 20 and 20; and a tip end which is slidably abutted on an inner circumference surface 5*a* of cam ring 5. Moreover, there are formed a plurality of pump chambers 21 which are hydraulic fluid chambers, and each of which is liquid-tightly separated by adjacent two of vanes 18, inner circumference surface 5*a* of cam ring 5, an outer circumference surface of rotor 4, bottom surface 1*a* of pump housing 1, and the inside end surface of pump cover 2. Each of vane rings 20 is arranged to push vanes 18 in the radially outward direction.

Cam ring 5 is formed into a substantially hollow cylindrical shape, and made from a sintered metal that can be easily-worked. Cam ring 5 includes a pivot raised portion 5*b* which is formed on an outer circumference surface of cam ring 5 on the right outer side of FIG. 1 on cam ring reference line X; and a support hole 5*c* which is formed at a central position of this pivot raised portion 5*b*, which is formed to penetrates through in the axial direction, into which pivot pin 10 inserted into and positioned by pivot hole 1*c* is inserted, and which serves as an eccentric swing support point (fulcrum) on which cam ring 5 is pivoted.

Moreover, cam ring 5 includes a first protruding portion 5*d* which has a substantially triangle shape, which is located on the upper side of cam ring reference line X in FIG. 1, and which includes a holding groove that holds first seal member 22*a* slidably abutted on first seal surface 1*d*; and a second protruding portion 5*e* which has a substantially triangular shape, which is located on the lower side of cam ring reference line X, and which includes a holding groove which holds second seal member 22*b* slidably abutted on second seal surface 1*e*.

Each of first and second seal members 22*a* and 22*b* is made from, for example, a synthetic resin having a low wear property. Each of first and second seal members 22*a* and 22*b* has an elongated shape extending in the axial direction of cam ring 5. Moreover, first and second seal members 22*a* and 22*b* are held, respectively, in the holding grooves formed in first and second protruding portions 5*d* and 5*e* of cam ring 5. Furthermore, each of first and second seal members 22*a* and 22*b* is arranged to be pushed in a forward direction, that is, on seal surfaces 1*d* and 1*e* by an elastic force of an elastic member which is made from rubber, and which is fixed on a bottom of one of the holding grooves. With this, first and second seal members 22*a* and 22*b* is arranged to constantly ensure the good liquid-tightness of first and second control hydraulic chambers 16 and 17.

First control hydraulic chamber 16 has a substantially elongated crescent shape. First control hydraulic chamber 16 is separated by first seal member 22*a,* the outer circumference surface of cam ring 5, and pivot pin 10. As described below, this first control hydraulic chamber 16 is arranged to swing cam ring 5 about pivot pin 10 in a counterclockwise direction of FIG. 1 by the discharge hydraulic pressure introduced from discharge port 12, and thereby to move cam ring 5 in a direction in which an eccentric amount (eccentricity) of cam ring 5 with respect to the center of rotor 4 is decreased.

On the other hand, second control hydraulic chamber 17 has a short irregular shape. Second control hydraulic chamber 17 is separated by second seal member 22*b*, the outer circumference surface of cam ring 5, and pivot pin 10. This second control hydraulic chamber 17 is arranged to swing cam ring 5 about pivot pin 10 in the clockwise direction of FIG. 1 by the discharge hydraulic pressure introduced from discharge port 12 through electromagnetic switching valve 8 and pilot valve 7, and thereby to move cam ring 5 in a direction in which the eccentric amount (eccentricity) of cam ring 5 with respect to rotor 4 is increased.

First and second control hydraulic chambers 16 and 17 are formed in the above-described ranges. Accordingly, a pressure receiving area of the outer circumference surface of cam ring 5 which receives the hydraulic pressure from first control hydraulic chamber 16 is larger than a pressure receiving area of the outer circumference surface of cam ring 5 which receives the hydraulic pressure from the second control hydraulic chamber 17.

Moreover, cam ring 5 includes an arm 23 which is integrally formed with an outer end of the outer circumference surface of cam ring 5, which is positioned on a side opposite to pivot raised portion 5*b*, and which protrudes in the radially outward direction.

Figure 5:
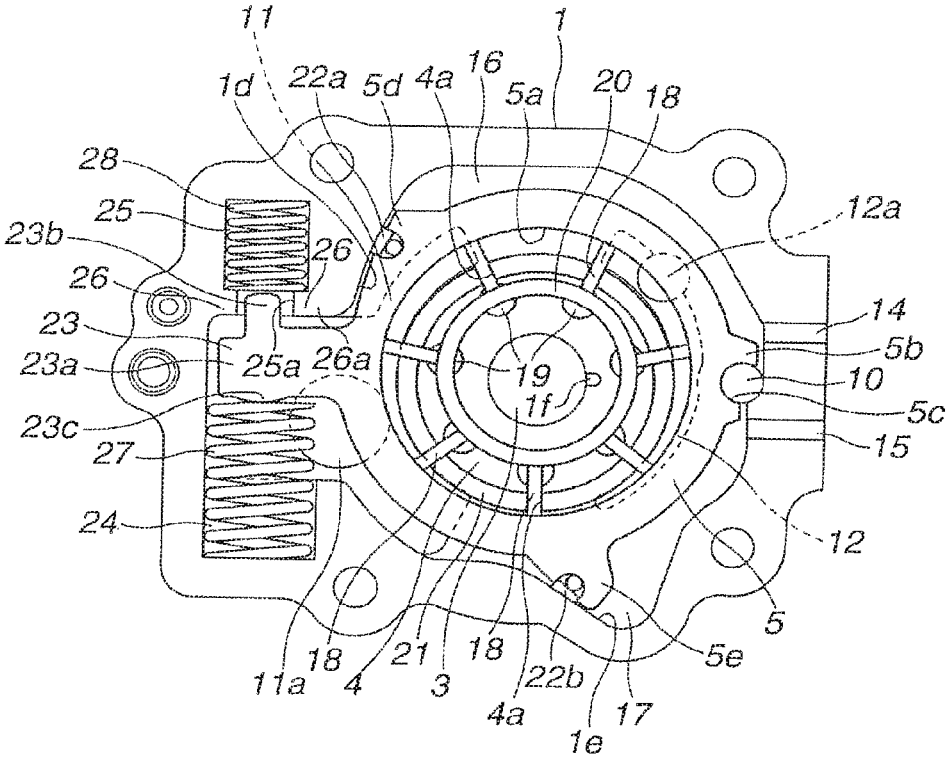
FIG. 5 is a view for illustrating an operation of the pump body of the variable displacement pump of FIG. 1.
Figure 6:
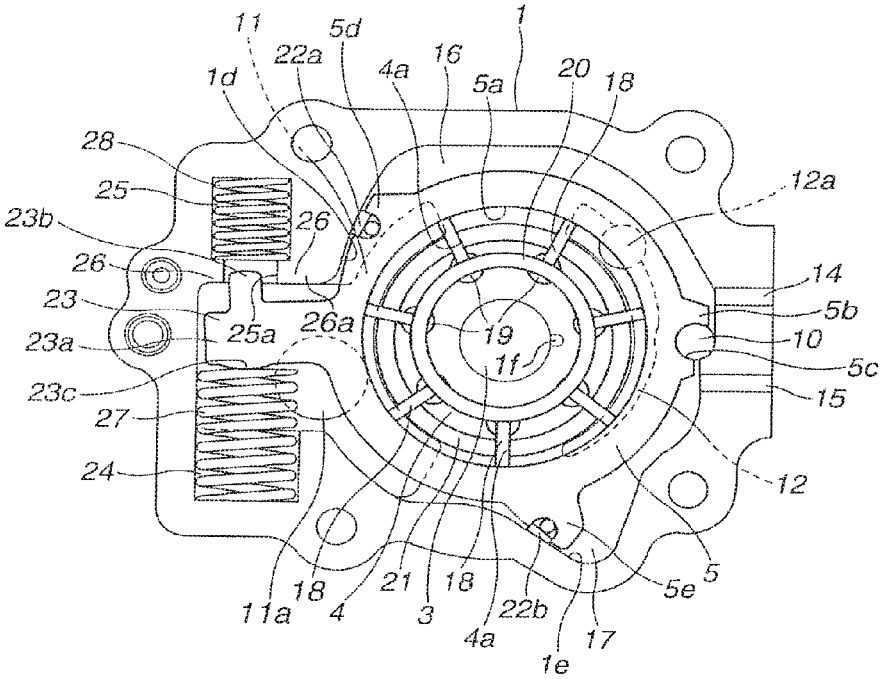
FIG. 6 is a view for illustrating the operation of the pump body of the variable displacement pump of FIG. 1.

As shown in FIGS. 1, 5, and 6, this arm 23 has an elongated rectangular plate shape extending from the outer end of cam ring 5 in the radial direction. Arm 23 includes a raised portion 23*b* which is integrally formed on an upper surface of arm 23 on a tip end portion 23*a*'s side.

Moreover, arm 23 includes a protrusion 23*c* which has an arc curved shape, and which is integrally formed on a lower surface of arm 23 that is opposite to raised portion 23*b*. The raised portion 23*b* extends in a direction substantially perpendicular to tip end portion 23*a*. Raised portion 23*b* has a narrow elongated rectangular shape in a planar view. Moreover, raised portion 23*b* includes an upper surface which has a curved shape having a small radius of curvature.

Moreover, there are formed a first spring receiving chamber 24 and a second spring receiving chamber 25 which are formed, respectively, at positions opposite to pivot hole 1*c* of pump housing 1, that is, upper and lower positions of arm 23 in FIGS. 1 and 3. First spring receiving chamber 24 and second spring receiving chamber 25 are formed to be coaxial with each other.

First spring receiving chamber 24 has a substantially rectangular shape in a planar view, which extends in the axial direction of pump housing 1. First spring receiving chamber 24 is connected to suction opening 11*a* which is a low pressure portion. On the other hand, second spring receiving chamber 25 has a length in the upward and downward directions, which is shorter than that of first spring receiving chamber 24. Moreover, second spring receiving chamber 25 has a substantially rectangular shape in a planar view, which extends in the axial direction of pump housing 1, similarly to first spring receiving chamber 24. Moreover, pump housing 1 includes a pair of retaining portions 26 and 26 each of which has an elongated rectangular plate shape, each of which extends radially inwards, which are integrally formed at an inner end edge of a lower end opening portion 25*a* of second spring receiving chamber 25 to confront each other in the widthwise direction of lower end opening portion 25*a*. Raised portion 23*b* of arm 23 is disposed to be moved into and out of second spring receiving chamber 25 through opening portion 25*a* between both retaining portions 26 and 26. The both retaining portions 26 and 26 are arranged to restrict a maximum extension of second coil spring 28.

A first coil spring 27 is received and disposed within first spring receiving chamber 24. First coil spring 27 is an urging member arranged to urge cam ring 5 through arm 23 in the clockwise direction of FIG. 1, that is, in a direction in which the eccentric amount between the rotation center of rotor 4 and the center of the inner circumference surface of cam ring 5 is increased.

First coil spring 27 includes a lower end which is elastically abutted on a bottom surface 24*a* of first spring receiving chamber 24, and an upper end which is elastically constantly abutted on arc protrusion 23*c* formed on the lower surface of arm 23, so that first coil spring 27 has a predetermined spring set load W1. With this, first coil spring 27 urges cam ring 5 in a direction in which the eccentric amount of cam ring 5 with respect to the center of the rotation of rotor 4 becomes larger.

A second coil spring 28 is received and disposed within second spring receiving chamber 25. Second coil spring 28 is an urging member arranged to urge cam ring 5 through arm 23 in the counterclockwise direction of FIG. 1. This coil spring 28 includes an upper end which is elastically abutted on an inner upper surface 25*b* of second spring receiving chamber 25, and a lower end which is elastically abutted on raised portion 23*b* of arm 23 from a maximum eccentric movement position of cam ring 5 shown in FIG. 1 in the clockwise direction until the lower end edge of coil spring 28 is abutted on the both retaining portions 26 and 26, to provide the urging force to cam ring 5 in the counterclockwise direction, that is, to urge cam ring 5 so as to decrease the eccentric amount of cam ring 5.

This second coil spring 28 is provided with a predetermined spring load W2 which is opposite to that of first coil spring 27. However, this spring load W2 is set to be smaller than spring set load W1 of first coil spring 27. Accordingly, cam ring 5 is set at an initial position (maximum eccentric position) by a difference between the spring loads W1 and W2 of first coil spring 27 and second coil spring 28.

In particular, first coil spring 27 is arranged to constantly urge cam ring 5 through arm 23 to be eccentric in the upward direction in a state in which first coil spring 27 is provided with spring set load W1, that is, in a direction in which the volumes of pump chambers 21 are increased. Spring set load W1 is a load by which cam ring 5 is started to be moved when the hydraulic pressure is a necessary hydraulic pressure P1 for the valve timing control device.

On the other hand, second coil spring 28 is elastically abutted on arm 23 when the eccentric amount of cam ring 5 between the center of the inner circumference surface of cam ring 5 and the center of the rotation of rotor 4 is equal to or greater than a predetermined amount. However, when the eccentric amount between the center of the inner circumference surface of cam ring 5 and the center of the rotation of rotor 4 becomes smaller than the predetermined amount as shown in FIGS. 5 and 6, second coil spring 28 is retained to hold the compressed state by retaining portions 26 and 26, so that second coil spring 28 is not abutted on arm 23. Moreover, the set load W1 of first coil spring 27 at the swing amount of cam ring 5 at which the load of the second coil spring 28 to arm 23 becomes zero by retaining portions 26 and 26 is a load at which cam ring 5 is started to be moved when the hydraulic pressure is a necessary hydraulic pressure P2 necessary for an oil jet of a piston, or a necessary hydraulic pressure necessary P3 for bearings at the maximum rotational speed of the crank shaft.

An urging mechanism is constituted by first coil spring 27 and second coil spring 28.

Figure 7:
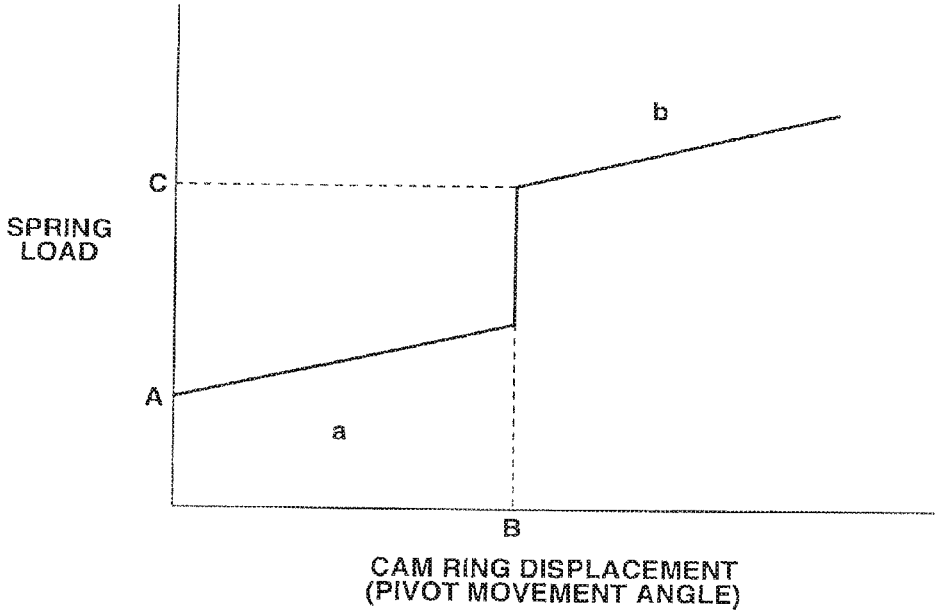
FIG. 7 is a graph showing a relationship between a spring load and a displacement of a cam ring in the variable displacement pump of FIG. 1.

FIG. 7 shows a relationship between a pivot movement angle of cam ring 5, and the spring loads of first and second coil springs 27 and 28. Even when the pivot movement angle of cam ring 5 is zero (the maximum eccentric position), the spring load A of coil spring 27 and 28 is provided. When the pivot movement angle of cam ring 5 is within a, spring load W2 of second coil spring 28 is acted as the assist force. Accordingly, cam ring 5 can be pivoted in the counterclockwise direction of FIG. 1 by the small load. In this case, a gradient of the spring load is a spring constant.

When cam ring 5 is moved to a position B of FIG. 7, the lower end of second coil spring 28 is abutted on the both retaining portions 26 and 26, so that cam ring 5 cannot obtain the assist force of second coil spring 28. Accordingly, cam ring 5 cannot be pivoted in the above-described direction. Moreover, when the hydraulic pressure becomes equal to or greater than the spring load C, that is, when the supply hydraulic pressure to first control hydraulic chamber 16 is increased and becomes greater than the spring load of first coil spring 27, cam ring 5 can be again pivoted against this spring load of first coil spring 27, and cam ring 5 can be pivoted to region b.

Besides, a variable mechanism is constituted by cam ring 5, vane rings 20 and 20, first and second control hydraulic pressure chambers 16 and 17, and first and second coil springs 27 and 28.

Moreover, there is formed a connection passage 35 which is bifurcated from branch passage 29, and which is connected to first connection groove 14 to be connected to first control hydraulic chamber 16. Branch passage 29 includes a downstream end connected to electromagnetic switching valve 8. Moreover, a hydraulic passage 36 connected to electromagnetic switching valve 8 includes a downstream end connected to an upper end of pilot valve 7 from the axial direction. Hydraulic passage 36 is connected through a supply and discharge passage 37 connected to this pilot valve 7, and second connection groove 15, to second control hydraulic chamber 17.

As shown in FIG. 1, this pilot valve 7 is provided within control housing 6 in the upward and downward directions. This pilot valve 7 includes a cylindrical sliding hole 30 which includes a bottom portion having an opening s that is closed by a cover member 31; a spool valve 32 which is provided within sliding hole 30, and which is arranged to be slid in the upward and downward directions; and a valve spring 33 which is elastically disposed between spool valve 32 and cover member 31, and which is arranged to urge spool valve 32 in the upward direction, that is, in a direction in which spool valve 32 closes an opening end 36*a* of hydraulic passage 36 which is formed on the upper end side of spool valve 32 in the axial direction.

Sliding hole 30 is connected to electromagnetic switching valve 8 through hydraulic passage 36 formed in the control housing 6 and the cylinder block. Moreover, supply and discharge passage 37 includes an one end opening 37*a* which is formed on an inner side surface of sliding hole 30. Furthermore, a drain passage 38 includes one end opening 38*a* which is formed at a position upper than one end opening 37*a* of supply and discharge passage 37. This drain passage 38 has a diameter smaller than that of supply and discharge passage 37. Moreover, this drain passage 38 includes the other end connected to an oil pan (not shown).

The opening end 36*a* of hydraulic passage 36 is formed to have an inside diameter smaller than an inside diameter of sliding hole 30. Between the opening end 36*a* of hydraulic passage 36 and sliding hole 30, there is formed a stepped seat surface 36*b* which is formed into a tapered shape. A first land portion 32*a* of spool valve 32 (described later) is arranged to be seated on and unseated s from this seal surface 36*b*.

This spool valve 32 includes first land portion 32*a* which is on an upper side, a second land portion 32*b* which is a central side, a third land portion 32*c* which is a lower side, and small diameter shaft portions which are formed between first land portion 32*a* and second land portion 32*b*, and between second land portion 32*b* and third land portion 32*c*. These first land portion 32*a*, second land portion 32*b*, third land portion 32*c*, and the small diameter shaft portions constitute a valve element. Moreover, spool valve 32 includes a passage hole 32*d* which has a bottomed cylindrical hollow shape, which extends in the axial direction, and which has an opening that is opened on the upper end side of first land portion 32*a*.

First land portion 32*a* is arranged to be seated on seat surface 36*b* by the spring force of valve spring 33, and thereby to close opening end 36*a* of hydraulic passage 36

The small diameter portions of spool valve 32 include, respectively, a first annular groove 32*e* and a second annular groove 32*f* which are formed on outer circumferences of the small diameter portions. The lower small diameter portion includes a through hole 32*g* which is formed in a circumferential wall of lower small diameter portion, which penetrates through in the radial direction, and which connects passage hole 32*d* and second annular groove 32*f*.

As shown in FIG. 1, passage hole 32*d* is arranged to connect the hydraulic passage 36 and discharge passage 37 through through hole 32*g* and second annular groove 32*f* when spool valve 32 is held at an uppermost position (maximum upper position) by the spring force of valve spring 32.

Figure 4:
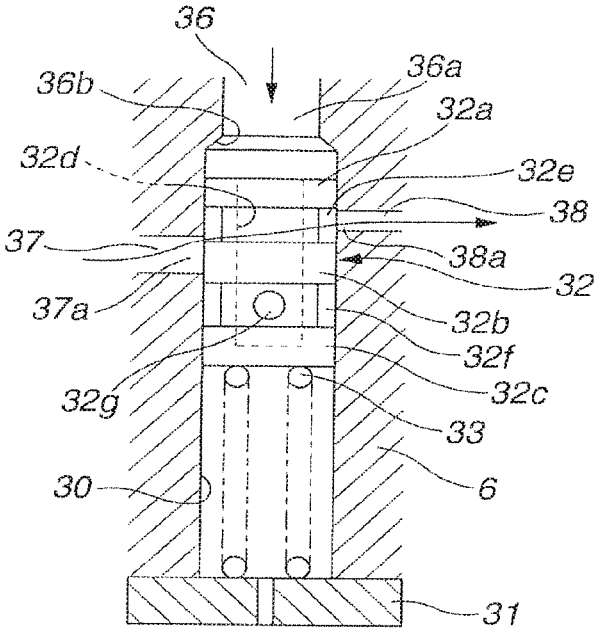
FIG. 4 is a longitudinal sectional view illustrating an operation of a pilot valve of the variable displacement pump of FIG. 1.

First annular groove 32*e* is arranged not to connect supply and discharge passage 37 and drain passage 38 by second land portion 32*b* when spool valve 32 is held at the uppermost position (maximum upper position) by the spring force of valve spring 33. However, as shown in FIG. 4, first annular groove 32*e* is arranged to connect supply and discharge passage 37 and drain passage 38 when spool valve 32 is moved to a predetermined position in the downward direction.

As shown in FIG. 1, electromagnetic switching valve 8 includes a valve body 40 which is fixed by the press-fit in a valve receiving hole that is formed at a predetermined position of a cylinder block, and which includes an operation hole 41 that is formed inside the valve body 40 to extend in the axial direction; a valve seat 42 which is fit in a tip end portion (on the left side in FIG. 1) of operation hole 41, and which includes a solenoid opening port 42*a* that is formed at a central portion of valve seat 42, and that is connected to a downstream side of branch passage 29; a ball valve 43 which is made from a metal, which is provided within valve seat 42, which is arranged to be seated on and unseated from valve seat 42 to open and close solenoid opening port 42*a;* and a solenoid portion 44 which is provided at one end portion of valve body 40.

Valve body 40 includes a connection port 45 which is formed at a left end portion of a circumferential wall of valve body 40, which penetrates through in the radial direction, and which is connected to hydraulic passage 36; and a drain port 46 which is formed at a right end portion of the circumferential wall of valve body 40, which penetrates through in the radial direction, and which is connected to operation hole 41.

Solenoid portion 44 includes a casing 44*a;* an electromagnetic coil, a fixed iron core, a movable iron core (not shown), and so on which are received within casing 44*a;* and a push rod 47 which is provided at a tip end portion of the movable iron core, which is arranged to be slid within operation hole 41 with a predetermined gap so that the tip end portion of push rod 47 pushes ball valve 43 or releases the pushing to ball valve 43.

There is formed a cylindrical passage 48 which is formed between an outer circumference surface of push rod 47 and an inner circumference surface of operation hole 41. Cylindrical passage 48 is arranged to connect connection port 45 and drain port 46.

The electromagnetic coil is arranged to be energized (applied with current) by a control unit (not shown) of the engine, or to be deenergized (not to be applied with the current) by the control unit, in an ON-OFF manner.

That is, when the control unit outputs an OFF signal (deenergization) to electromagnetic coil, the movable iron core is moved in a forward direction (in the leftward direction in FIG. 1) by a spring force of a return spring (not shown) so that push rod 47 pushes ball valve 43. Consequently, solenoid opening port 42*a* is closed, and connection port 45 and drain port 46 are connected with each other through cylindrical passage 48.

On the other hand, when the control unit outputs an ON signal (energization) to the electromagnetic coil, the movable iron core is moved in a rearward direction (in the rightward direction in FIG. 1) against the spring force of the return spring so that the pushing of push rod 47 to ball valve 43 is released. With this, as shown in FIG. 1, branch passage 29 and hydraulic passage 36 are connected through connection port 45, and cylindrical passage 48 is closed so as to disconnect connection port 45 and drain port 46.

The control unit senses a present driving state of the engine from an oil temperature, a water temperature, an engine speed, a load and so on of the engine. In particular, the control unit energizes the electromagnetic coil when the engine speed is smaller than fin FIG. 8. The control unit deenergizes the electromagnetic coil when the engine speed is higher than f of FIG. 8.

Figure 8:
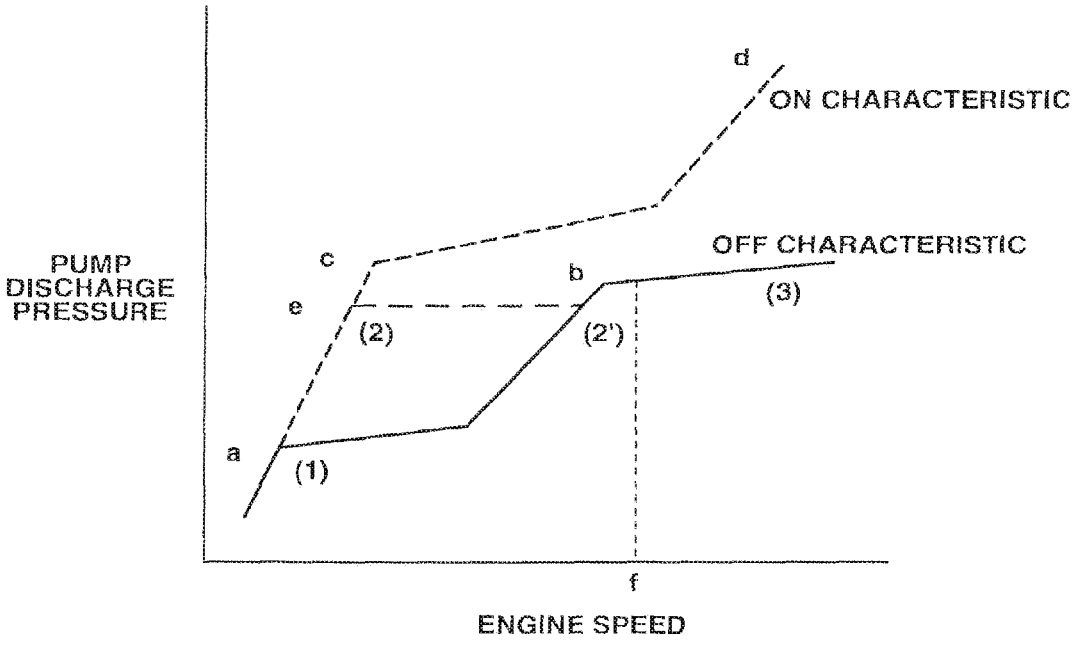
FIG. 8 is a characteristic view showing a relationship between a discharge hydraulic pressure and an engine speed in the variable displacement pump of FIG. 1.

However, even if the engine speed is equal to or smaller than fin FIG. 8, the control unit shuts off the energization to the electromagnetic coil when the engine is in the high load region, and so on.

Functions of First Embodiment

Hereinafter, functions of the present embodiment will be illustrated. First, functions of the pump main body will be illustrated.

In FIG. 1, the upper surface of arm portion 23 of cam ring 5 is abutted on a stopper surface 26*a* which is located at a lower end of one of retaining portion 26, by a resultant force of the spring forces of first coil spring 27 and second coil spring 28. In this state, the eccentric amount is maximized, and the variations of the volumes of the pump chambers 21 according to the rotation are maximized. Accordingly, the capacity of the oil pump are maximized.

Rotor 4 of the pump main body is rotated in the clockwise direction in FIG. 1. Accordingly, pump chambers 21 on the left side in FIG. 1 are expanded in a state where pump chambers 21 on the left side in FIG. 1 are opened to suction port 11. Suction port 11 is connected through suction opening 11*a* to the oil pan outside the pump. Accordingly, suction port 11 can suck the oil from the oil pan. Pump chambers 21 on the right side in FIG. 1 are contracted in a state where pump chambers 21 on the right side in FIG. 1 are opened to discharge port 12. Accordingly, the oil is discharged to discharge port 12. Discharge port 12 is connected to main oil gallery 13 through discharge opening 12*a* and discharge passage 12*b*. Basically, the discharged oil is supplied to sliding portions of the engine.

When the pump discharge pressure is increased in accordance with the increase of the engine speed, the hydraulic pressure is introduced through branch passage 29, connection passage 35, and first connection groove 14 to first control hydraulic chamber 16. The hydraulic pressure introduced into first control hydraulic chamber 16 is acted to an upper outer circumference surface (pressure receiving surface) of cam ring 5, and serves as a force by which cam ring 5 is pivoted on pivot pin 10 in the counterclockwise direction against the spring force of first coil spring 27. In this case, the spring force of second coil spring 28 serves as the assist force for pivoting cam ring 5.

When cam ring 5 is pivoted in the counterclockwise direction to become the state shown in FIG. 5, second coil spring 28 is abutted on the upper surfaces of retaining portions 26 and 26. Accordingly, second coil spring 28 does not act the assist force to arm portion 23. Moreover, it is necessary that the hydraulic pressure of first control hydraulic chamber 16 is increased until the hydraulic pressure force becomes larger than the spring load of first coil spring 27, for pivoting cam ring 5 to become the state shown in FIG. 6.

Next, a relationship between the engine speed and the pump discharge pressure is shown by a solid line of FIG. 8.

In a state immediately after the engine start, the pump main body is in the state shown in FIG. 1. The hydraulic pressure of main oil gallery 13 is acted only to first control hydraulic chamber 16 through branch passage 29, connection passage 35, and first connection groove 14. At this time, the eccentric amount of cam ring 5 is the largest (maximum), and the pump is in the state of the maximum capacity. Accordingly, the hydraulic pressure is rapidly increased in proportional to the increase of the rotation (the engine speed).

When this hydraulic pressure reaches a in FIG. 8 which is larger than (1) in FIG. 8 that is a necessary hydraulic pressure of the valve timing control device, the hydraulic pressure force acted to first control hydraulic chamber 16 and the spring force of second coil spring 28 become larger than the spring force of first coil spring 27, so that cam ring 5 is started to be pivoted in a direction (in the counterclockwise direction) in which the eccentric amount of cam ring 5 is decreased.

In this way, when cam ring 5 is pivoted in the direction in which the eccentric amount of cam ring 5 is decreased, the pump capacity of the pump main body is decreased. Accordingly, the increase of the hydraulic pressure at the increase of the engine speed becomes gentle. When cam ring 5 is pivoted to become the state shown in FIG. 5, second coil spring 28 is abutted on the both retaining portions 26 and 26 while having the spring load, so that it does not become possible to suddenly obtain the assist force of second coil spring 28.

Accordingly, cam ring 5 cannot be pivoted. Consequently, the eccentric amount of cam ring 5 is fixed to the constant amount, so that the pump capacity of the pump main body is fixed to the constant value. Therefore, the hydraulic pressure is increased in proportion to the increase of the engine speed.

However, the eccentric amount of cam ring 5 becomes smaller than the eccentric amount in the state of FIG. 1. Accordingly, the gradient of the increase of the hydraulic pressure becomes smaller than the gradient of the increase of the hydraulic pressure immediately after the engine start.

When the hydraulic pressure reaches b in FIG. 8 that is greater than a necessary hydraulic pressure (3) of the bearings of the crank shaft, cam ring 5 can be again started to be pivoted by the hydraulic pressure force acted to first control hydraulic chamber 16 against the spring force of first coil spring 27, so that the oil pump becomes the state of FIG. 6. Moreover, when there is an oil jet necessary hydraulic pressure (2') during the process between (1) and (3), the eccentric amount of the state shown in FIG. 5 is set to satisfy the oil jet necessary hydraulic pressure (2').

Next, the operation of the entire variable displacement pump including pilot valve 7 and electromagnetic switching valve 8, and also the hydraulic pressure characteristic of FIG. 8 are illustrated.

That is, when the engine speed is in the low speed region, the upper surface of arm portion 23 is abutted on stopper portion 26*a* by the spring force of first coil spring 27 of the pump main body as shown in FIG. 1, as described above. Accordingly, the eccentric amount of cam ring 5 becomes maximum, so that the pump is in the state of the maximum discharge amount.

Electromagnetic switching valve 8 becomes the deenergization state in which the control unit outputs the OFF signal. Accordingly, push rod 47 is moved in the forward direction by the spring force of the return spring within solenoid portion, as shown by a chain line of FIG. 1. Consequently, ball valve 43 is seated on the valve seat so that solenoid opening port 42*a* is closed. Therefore, branch passage 29 and hydraulic passage 36 are disconnected, and hydraulic passage 36 and drain port 46 are connected with each other.

In hydraulic passage 36, the upper surface of first land portion 32*a* of pilot valve 7 confronts opening end 36*a*. Accordingly, the hydraulic pressure is not acted to spool valve 32. Consequently, spool valve 32 is pressed on seat portion 36*b* by the spring force of valve spring 33.

In this way, when spool valve 32 is abutted on seat portion 36*b*, second annular groove 32*f* of the second small diameter shaft portion is connected to one end opening 37*a* of supply and discharge passage 37. First annular groove 32*e* of the first small diameter portion is connected to one end opening 38*b* of drain passage 38. Besides, second land portion 32*b* is positioned between first annular groove 32*e* and second annular groove 32*f*, so that first annular groove 32*e* and second annular groove 32*f* are disconnected from each other.

Supply and discharge passage 37 is connected to second connection groove 15 of the pump main body. Accordingly, second control hydraulic chamber 17 is connected to drain port 46 through through hole 32*g*, passage hole 32*d*, hydraulic passage 36, and the connection port 45 of electromagnetic switching valve 8, so that second control hydraulic chamber 17 is opened to the oil pan. Consequently, the hydraulic pressure is not acted to the second control hydraulic chamber 17.

Accordingly, the oil pump becomes the hydraulic pressure characteristic shown by the solid line in FIG. 8 at the increase of the engine speed, as described above. When the hydraulic pressure exceeds the first operation pressure a, cam ring 5 is pivoted in the counterclockwise direction to become the state shown in FIG. 5. When the hydraulic pressure exceeds the second operation pressure b, cam ring 5 is further pivoted in the counterclockwise direction to become the state shown in FIG. 6.

In this way, at the request of the minimum hydraulic pressure of the engine, electromagnetic switching valve 8 can be brought to the OFF state (the deenergization state) from the timing immediately after the engine start to the high engine speed. Accordingly, it is possible to eliminate the electricity consumption.

At the high load state of the engine, it is necessary to cool the piston by the injection of the oil jet even at the low engine speed. In this case, electromagnetic switching valve 8 is energized so that push rod 47 is moved in the rearward direction. With this, branch passage 29 is connected to supply and discharge passage 37 through passage hole 32*d*, through hole 32*g*, and second annular groove 32*f* of pilot valve 7, so as to increase the hydraulic pressure of second control hydraulic chamber 17. With this, cam ring 5 is pivoted in the clockwise direction by the resultant force of the hydraulic s pressure of second control hydraulic chamber 17 and first coil spring 27, so as to increase the eccentric amount of cam ring 5.

That is, when electromagnetic switching valve 8 is energized by the control unit, push rod 47 is moved in the rearward direction (in the rightward direction in FIG. 1) against the spring force of the return spring. With this, ball valve 43 is moved in the rearward direction by the hydraulic pressure from branch passage 29, so that branch passage 29 and hydraulic passage 36 are connected with each other. Moreover, the opening end of cylindrical passage 48 is closed, so that drain port 46 is shut off.

Supply and discharge passage 37 of pilot valve 7 is connected to second control hydraulic chamber 17 through second connection groove 15 of the pump main body. Accordingly, the hydraulic pressure of branch passage 29 (main oil gallery 13) is acted to second control hydraulic chamber 17 through hydraulic passage 36 of pilot valve 7 and connection port of electromagnetic switching valve 8.

When the hydraulic pressure is acted to second control hydraulic chamber 17, this hydraulic pressure serves as a force for pivoting cam ring 5 in the direction (in the clockwise direction) identical to the spring force of first coil spring 27. Moreover, the hydraulic pressure force of second control hydraulic chamber 17 is smaller than the hydraulic pressure force of first control hydraulic chamber 16 since the pressure receiving area of second control hydraulic chamber 17 is smaller than the pressure receiving area of first control hydraulic chamber 16, and a radius R of second seal surface 1*e* from the pivot point is small. Accordingly, the hydraulic pressure acted to second control hydraulic chamber 17 serves to decrease the hydraulic pressure force of first control hydraulic chamber 16 by the area ratio and the ratio of radii R of first and second seal surfaces 1*d* and 1*e*.

The operation of cam ring 5 is identical that in the above-described OFF state (the deenergization state) of electromagnetic switching valve 8. However, the operation hydraulic pressure is increased since the hydraulic pressure force of first control hydraulic chamber 16 is decreased. Consequently, the hydraulic pressure characteristic becomes a characteristic shown by a short dot line of FIG. 8.

The pressure receiving area of second control hydraulic chamber 17 is set so that first operation pressure c at this time becomes higher than necessary hydraulic pressure (2) of the oil jet so as to surely perform the injection of the oil jet.

However, in the pump discharge pressure characteristic shown by e-d in the short dot line of FIG. 8, the hydraulic pressure is excessively high. Accordingly, the increase of the friction, the breakage of the other components may be generated. Therefore, it is necessary to control the hydraulic pressure.

That is, when the hydraulic pressure of hydraulic passage 36 is increased, spool valve 32 of pilot valve 7 is started to be moved in the downward direction against the spring force of valve spring 33. Then, when the hydraulic pressure reaches a switching hydraulic pressure e shown in FIG. 8, pilot valve 7 is positioned at a downward movement position (lower position) shown in FIG. 4.

In this state, a width of the opening of supply and discharge passage 37 becomes substantially identical to a width of second land portion 32*b*. Accordingly, pilot valve 7 becomes a three-way valve which is arranged to selectively switch a portion connected to supply and discharge passage 37, so that supply and discharge passage 37 is connected through second annular groove 32*f* to hydraulic passage 36, or so that supply and discharge passage 37 is connected through first annular groove 32*e* to drain passage 38. Consequently, the portion connected to second control hydraulic chamber 17 connected to supply and discharge passage 37 is switched from main oil gallery 13 to drain passage 18.

That is, second land portion 32*b* of pilot valve 7 shuts off the connection between hydraulic passage 36 and supply and discharge passage 37, and connects supply and discharge passage 37 and drain passage 38. With this, the hydraulic pressure of second control hydraulic chamber 17 is decreased. Consequently, cam ring 5 is started to be pivoted at a hydraulic pressure lower than the hydraulic pressure when the hydraulic pressures of first and second control hydraulic chambers 16 and 17 are identical to each other.

When the hydraulic pressure of second control hydraulic chamber 17 is extremely low, the pivot movement amount of cam ring 5 in the counterclockwise direction becomes large, so that the pump discharge amount is decreased. Consequently, the hydraulic pressure of main oil gallery 13 is lowered. Therefore, second land portion 32*b* is slightly moved in the upward direction by the spring force of valve spring 33 so that the opening area of the connection between first annular groove 32*e* and supply and discharge passage 37 becomes small. With this, the oil drain amount from drain passage 38 is decreased, so that the hydraulic pressure of second control hydraulic chamber 17 is increased.

When the hydraulic pressure within second control hydraulic chamber 17 is extremely high, the pivot movement amount of cam ring 5 in the clockwise direction becomes large, so that the discharge amount becomes excessive. With this, the hydraulic pressure of main oil gallery 13 becomes high. Accordingly, second land portion 32*b* is moved in the downward direction against the spring load of valve spring 33, so that the opening area of the connection between first annular groove 32*e* and supply and discharge passage 37 becomes large. Consequently, the drain amount is increased, so that the hydraulic pressure of second control hydraulic chamber 17 is lowered.

In this way, at the predetermined hydraulic pressure (pump discharge pressure) e shown in FIG. 8, the connection between supply and discharge passage 37 and hydraulic passage 36 is disconnected, and the connection between drain passage 38 and supply and discharge passage 37 is started, and after that, the hydraulic pressure of second control hydraulic chamber 17 is controlled by the opening areas of the connection of the both passages 38 and 37.

Moreover, the opening areas of the both passages 38 and 37 can be controlled by a small movement amount of second land portion 32*b*. Accordingly, the opening areas of the both passages 38 and 37 receive little or no influence of spring constant of valve spring 33.

That is, it is possible to sufficiently vary the opening areas of the connection even by the small variation of the hydraulic pressure. The hydraulic pressure is not increased even when the engine speed becomes equal to or greater than f, as shown in a long dot line in FIG. 8. It is possible to control to the substantially constant pressure e Moreover, in a state in which supply and discharge passage 37 and drain passage 38 are fully connected with each other, the hydraulic pressure is not acted to second control hydraulic chamber 17. Accordingly, electromagnetic switching valve 8 becomes a state identical to the OFF state (the deenergization). Accordingly, the hydraulic pressure characteristic becomes identical to the state shown by the solid line in FIG. 8.

As described above, the inside diameter of opening end 37*a* of supply and discharge passage 37 is substantially identical to the width of second land portion 32*b*. However, one of the inside diameter of opening end 37*a* of supply and discharge passage 37 and the width of second land portion 32*b* may be slightly larger than the other of the inside diameter of opening end 37*a* of supply and discharge passage 37 and the width of second land portion 32*b*. Moreover, both of the upper and lower outer circumference edges of second land portion 32*b*, or one of the upper and lower outer circumference edges of second land portion 32*b* may be chamfered or be shaped into a curved shape (an R-shape). Even when the width of second land portion 32*b* is greater than the inside diameter of opening end 37*a* of supply and discharge passage 37, there is a slight gap between second land portion 32*b* and the inside diameter of sliding hole 30. Accordingly, the three ways (directions) of pilot valve 7 are not fully closed.

The above-described control operation varies a relationship between the displacement of spool valve 32 and the variations of the opening areas of the connections. The relationship between the displacement of spool valve 32 and the variations of the opening areas of the connections are appropriately selected and used in accordance with the specification of the pump main body and the operation pressure.

Then, in other embodiments described later, it is identical in all of supply and discharge passage 37 and spool valve 32 which has the same functions.

As described above, the pump apparatus according to this embodiment makes it possible to obtain the two-stepped hydraulic pressure characteristics in which the hydraulic pressure at the low engine speed is decreased while the electricity consumption is suppressed by deenergizing electromagnetic switching valve 8. Moreover, it is possible to increase only the hydraulic pressure at the low engine speed in accordance with the request of the engine side.

As the setting for maximally obtaining this effect, switching pressure e of pilot valve 7 shown in FIG. 8 is set to be greater than the valve opening pressure (2) of the oil jet, and equal to or smaller than second operation pressure b. With this, even when the electromagnetic switching valve 8 is brought to the ON state (the energization), the hydraulic pressure does not exceed the maximum hydraulic pressure when electromagnetic switching valve 8 is switched to the OFF state (the deenergization). Moreover ,it is possible to prevent the increase of the friction by increasing the hydraulic pressure unnecessarily.

Moreover, at the increase of the engine speed, a timing when electromagnetic switching valve 8 is switched from the ON state to the OFF state is set to a timing after the hydraulic pressure exceeds second operation pressure b, or after the engine speed at which the hydraulic pressure reaches second operation pressure b.

Accordingly, at the engine speed at which the piston needs to be cooled by the injection of the oil jet, it is possible to prevent the injection of the oil jet from stopping due to the deficiency of the hydraulic pressure by the OFF state of electromagnetic switching valve 8.

Moreover, in this variable displacement pump according to this embodiment, first and second oil filters 50 and 51 are provided on the upstream side of main oil gallery 25, and at a portion of branch passage 29 near the bifurcating portion. Accordingly, it is possible to sufficiently prevent the ingress of the contamination such as the metal powder to pilot valve 7 and electromagnetic switching valve 8 by the double filtration. Accordingly, it is possible to prevent the malfunction of the pilot valve 7 and the electromagnetic switching valve 8 due to the contamination.

Even when first and second filters 50 and 51 are clogged, the hydraulic pressure is not introduced into control hydraulic chamber 16. With this, cam ring 5 is maintained in the maximum eccentric state. Accordingly, when the pump discharge pressure becomes excessive, the relief valve is actuated so as to suppress the excessive increase of the pump discharge pressure. In this way, it is possible to ensure the high hydraulic pressure even at the malfunction such as the clogging of the hydraulic circuit. Accordingly, it is possible to sufficiently suppress the malfunction of the engine due to the deficiency of the hydraulic pressure at the high engine speed and the high load of the engine.

Second Embodiment

Figure 9:
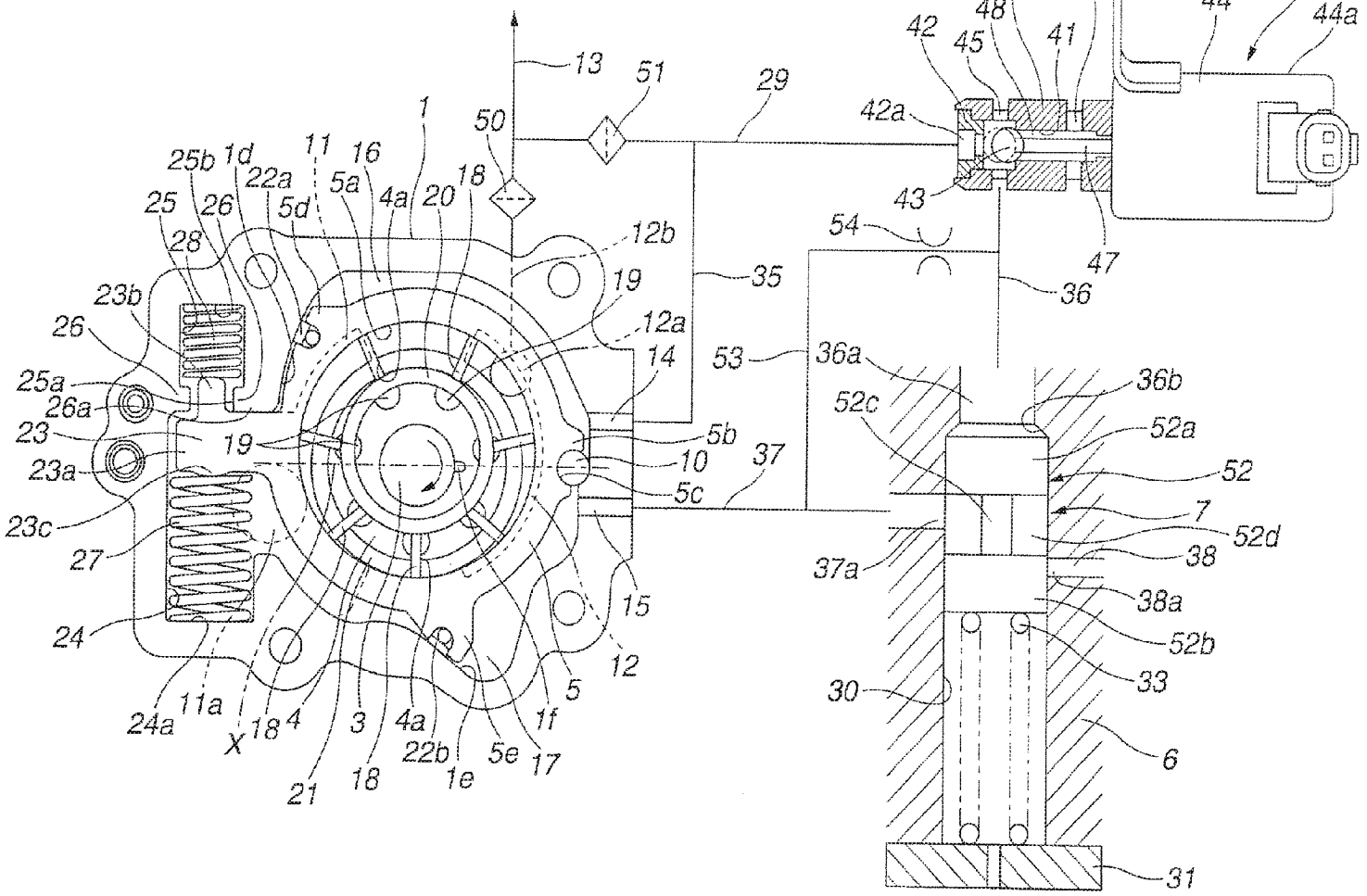
FIG. 9 is a schematic view showing a variable displacement pump according to a second embodiment of the present invention.

FIG. 9 shows a variable displacement pump according to a second embodiment of the present invention. The structure of the pump main body and the structure of electromagnetic switching valve 8 in the variable displacement pump according to the second embodiment of the present invention are substantially identical to those of the variable displacement pump according to the first embodiment in most aspects as shown by the use of the same reference numerals. Accordingly, the repetitive illustrations are omitted. In the variable displacement pump according to the second embodiment of the present invention, a structure of pilot valve 7 and structures of the passages are different from those of the variable displacement pump according to the first embodiment. Therefore, hereinafter, these are illustrated.

That is, in pilot valve 7, sliding hole 30, and drain passage 38 having one end opening 38*a* formed in sliding hole 30 are formed within control housing 6. Siding hole 30 is formed to have a uniform inside diameter. A lower end portion of sliding hole 30 which is opened is sealed by a cover member 31.

A spool valve 52 is arranged to be slid within sliding hole 30 with a minute clearance. Spool valve 52 includes first and second land portion 52*a* and 52*b;* a small diameter shaft portion 52*c* formed between first and second land portions 52*a* and 52*b;* and an annular groove 52*d* formed radially outside small diameter shaft portion 52*c*. Moreover, spool valve 52 is urged by the spring force of valve spring 33 elastically mounted between spool valve 52 and cover member 31 in a direction in which first land portion 52*a* is seated on seat portion 36*b* to close opening end 36*a* of hydraulic passage 36. This valve spring 33 has a predetermined spring load.

On an inner side surface of sliding hole 30, there is formed one end opening 37*a* of supply and discharge passage 37 which is positioned at an upper position of drain passage 38, in addition to drain passage 38.

Moreover, there is formed a bypass passage 53 between hydraulic passage 36 and supply and discharge passage 37. Furthermore, there is provided an orifice 54 which is positioned in bypass passage 53 on the hydraulic passage 36's side, and which is a throttling portion.

Function in Second Embodiment

Hereinafter, functions of the variable displacement pump according to the second embodiment is illustrated. First, a basic operation of the pump main body is briefly illustrated with reference to the hydraulic pressure characteristic of FIG. 8.

FIG. 9 shows an operation state of pilot valve 7 in an initial state in which the engine speed is low and the pump discharge pressure is low. In a state in which spool valve 52 is seated on seat portion 36*b* by the spring force of valve spring 33, annular groove 52*d* is opened to opening portion 37*a* of supply and discharge passage 37. On the other hand, the one end opening 36*a* of hydraulic passage 36 is closed by first land portion 52*a,* and opening end 38*a* of drain passage 38 is closed by second land portion 52*b*.

Second connection groove 15 (second control hydraulic chamber 17) of the pump main body is connected to connection port 45 of electromagnetic switching valve 8 by bypass passage 53. Moreover, second connection groove 15 of the pump main body is connected to drain port 46 through connection port 45 and cylindrical passage 48 to be connected to the oil pan, so that the hydraulic pressure is not actuated to second control hydraulic chamber 17.

Accordingly, when the electromagnetic coil of electromagnetic switching valve 8 is not energized to be switched to the OFF state, it is possible to obtain the hydraulic pressure characteristic shown by the solid line of FIG. 8, similarly to the first embodiment.

When the electromagnetic coil of electromagnetic switching valve 8 is energized to be switched to the ON state, branch passage 29 and hydraulic passage 36 are connected, and this hydraulic passage 36 is connected through bypass passage 53 to second control hydraulic chamber 17 of the pump main body. Accordingly, the hydraulic pressure of main oil gallery 13 is supplied to second control hydraulic chamber 17. Consequently, the hydraulic pressure characteristic becomes the state shown by the short dot line in FIG. 8, similarly to the first embodiment, so that similarly there is generated the identical problem of the excessive hydraulic pressure.

Figure 10:
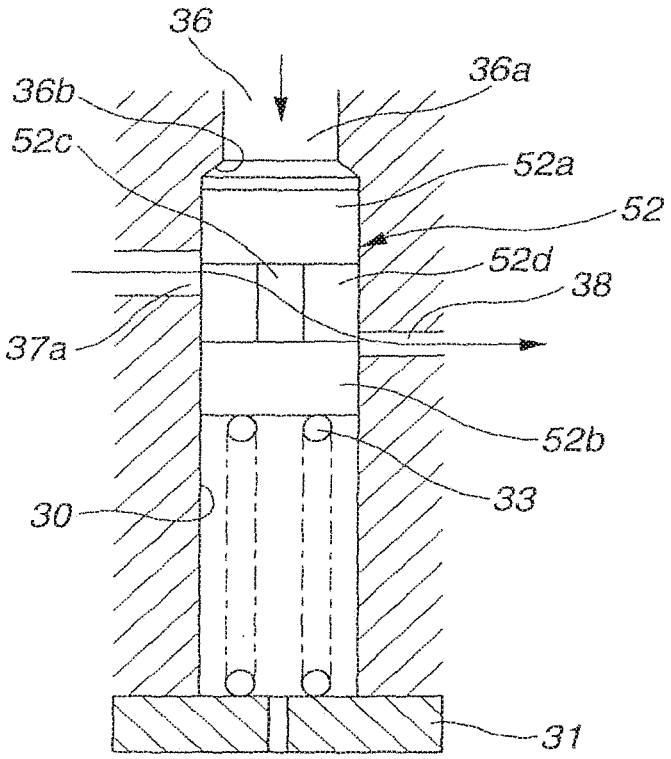
FIG. 10 is a view for illustrating an operation of a pilot valve of the variable displacement pump of FIG. 9.

Accordingly, at the hydraulic pressure e shown in FIG. 8, in pilot valve 7, spool valve 52 is slightly moved in the downward direction by the hydraulic pressure acted to hydraulic passage 36 against the spring force of valve spring 33, as shown in FIG. 10.

In this state, annular groove 52*d* of spool valve 52 is opened to one end opening 37*a* of supply and discharge passage 37 and opening end 38*a* of drain passage 38 so as to connect supply and discharge passage 37 and drain passage 38, so that the hydraulic pressure of second control hydraulic chamber 17 is drained. This drain amount is controlled by an opening area of drain passage 38 which is varied in accordance with a movement position of second land portion 52*b*.

That is, the hydraulic pressure of second control hydraulic chamber 17 is controlled to be decreased in accordance with the drain amount which is varied in accordance with the movement position of spool valve 52 which is controlled by the function of orifice (throttling portion) 54 on the bypass passage 53. Pilot valve 7 is not the three-way switching valve, unlike the first embodiment. However, the function and effects of pilot valve 7 in the second embodiment are identical to those of the first embodiment. Accordingly, it is possible to obtain the hydraulic pressure characteristic shown by the long dot line of FIG. 8.

The setting and the effects of pilot valve 7 are identical to those of pilot valve 7 in the first embodiment. However, in the second embodiment, it is possible to simplify the structure of spool valve 52. Accordingly, it is possible to improve the workability of the manufacturing operation, and to decrease the cost.

Third Embodiment

FIGS. 11-14 show a variable displacement pump according to a third embodiment of the present invention. In this third embodiment, first control hydraulic chamber 16 and a second control hydraulic chamber 57 do not sandwich pivot pin 10. First control hydraulic chamber 16 and second control hydraulic chamber 57 are disposed in parallel with each other on the upper side of pivot pin 10 in FIG. 11. Accordingly, when the hydraulic pressure is introduced into either of control hydraulic chambers 16 and 57, the eccentric amount of cam ring 5 is decreased, and the pump capacity is decreased.

Moreover, main oil gallery 13 is constantly connected through connection passage 35 to first control hydraulic chamber 16, and connected through first branch passage 29 to solenoid opening port 42*a* of electromagnetic switching valve 8. Furthermore, main oil gallery 13 is connected through a second branch passage 59 to a downstream side opening end 59*a* of pilot valve 7.

Arm 23 of cam ring 5 includes raised portion 23*b* which is integrally formed on the lower surface of tip end portion 23*a* of arm 23.

Moreover, first coil spring 27 includes a large diameter coil spring 27*a* which has a large diameter, and which is disposed on the outside; and a small diameter coil spring 27*b* which is disposed radially inside large diameter coil spring 27*a*. Accordingly, first coil spring 27 is constituted by two inside and outside coil springs.

Figure 11:
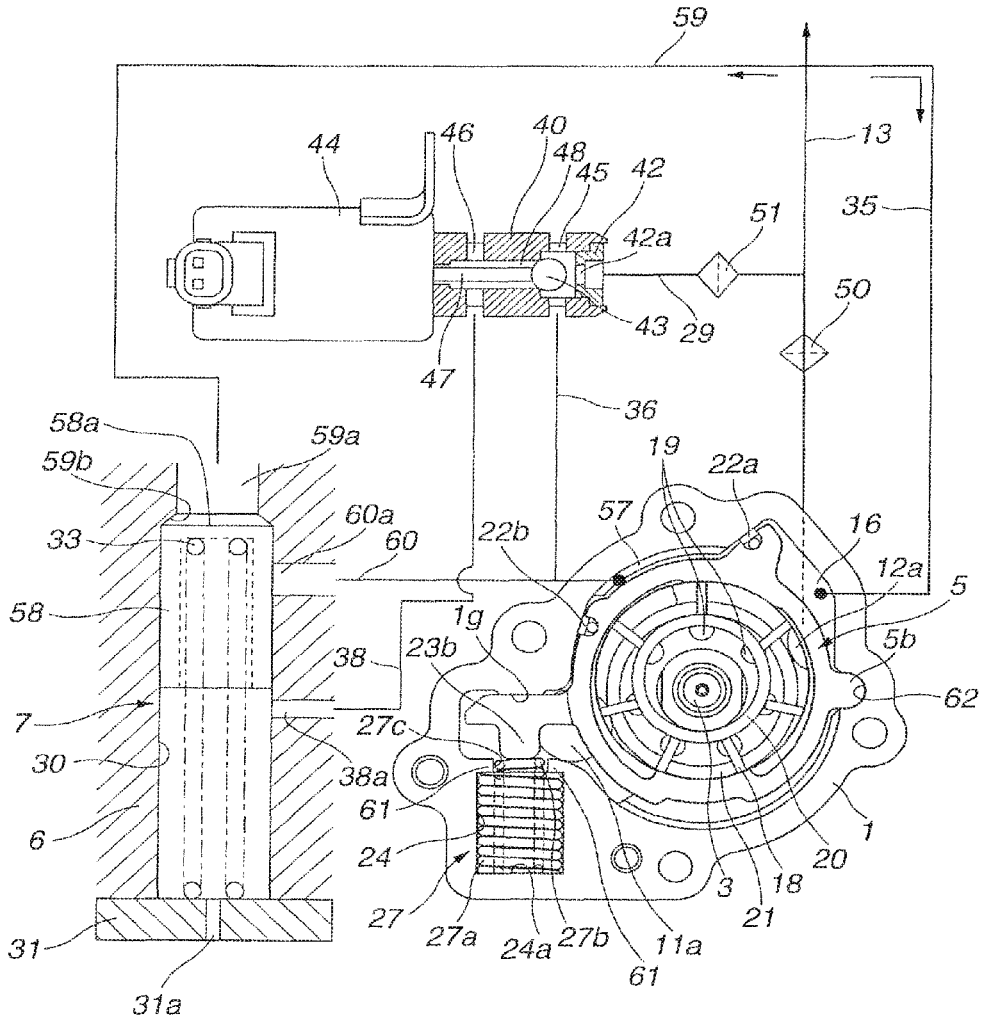
FIG. 11 is a schematic view showing a variable displacement pump according to a third embodiment of the present invention.
Figure 12:
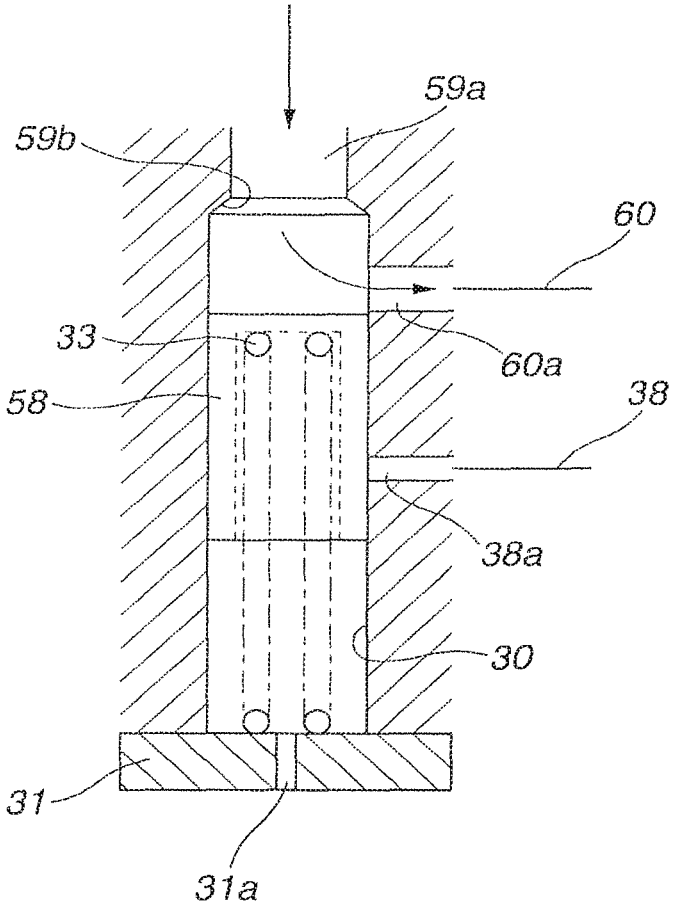
FIG. 12 is a view for illustrating an operation of a pilot valve of the variable displacement pump of FIG. 11.

At the initial position shown in FIG. 11, an upper end portion 27*c* of small diameter coil spring 27*b* protrudes from large diameter coil spring 27*a* so as to be elastically abutted on raised portion 23*b* of tip end portion 23*a* of arm 23. On the other hand, an upper end portion of large diameter coil spring 27*a* is elastically abutted on lower surfaces of a pair of retaining portions 61 and 61 which are integrally formed on an inner circumference of the upper end opening of spring receiving chamber 24.

Pilot valve 7 includes a valve element 58 which is slidably received within sliding hole 30, which is not formed into the spool shape, and which is formed into a bottomed cylindrical shape. Valve body 58 of pilot valve 7 is arranged to be moved in the downward direction in accordance with the hydraulic pressure of main oil gallery 13 which is acted to upper end surface 58*a* from opening end 59*a* of second branch passage 59. Moreover, at an upper portion of an inner circumference surface of sliding hole 30, there is formed an upstream opening end 60*a* of a hydraulic pressure supply passage 60 which includes a downstream end connected to second control hydraulic chamber 57. Furthermore, at a lower portion of the inner circumference surface of sliding hole 30, there is formed one end opening 38*a* of drain passage 38. This drain passage 38 includes the other end portion connected to drain port 46 of electromagnetic switching valve 8. The one end opening 38*a* of drain passage 38 is connected to the outside through sliding hole 30 and a drain hole 31*a* formed at a central portion of cover member 31.

Moreover, valve element 58 is urged by valve spring 33 elastically mounted between an upper inside wall of valve element 58 and cover member 31, in a direction in which valve element 58 is seated on a tapered seat surface 59*b*.

The control unit judges to energize or deenergize electromagnetic switching valve 8 in accordance with the oil temperature, the water temperature, the engine speed, the engine load and so on, and controls the ON state (the energization)—the OFF state (the deenergization).

That is, in electromagnetic switching valve 8, push rod 47 is returned to be moved in the rearward direction (in the leftward direction in FIG. 11) when the control unit deenergizes the electromagnetic coil, so that ball valve 43 is pushed by the hydraulic pressure of first branch passage 29 so as to close cylindrical passage 48 to close drain port 46. Moreover, ball valve 43 opens connection port 45 so as to connect first branch passage 29 and hydraulic passage 36.

When the electromagnetic coil is energized, push rod 47 is pushed in the forward direction (in the rightward direction in FIG. 11) so as to push ball valve 43 to close solenoid opening port 42*a*. Moreover, hydraulic passage 36 and drain port 46 are connected with each other through connection port 45. Furthermore, this drain port 46 is connected to the outside through drain passage 38, sliding hole 30, and drain hole 31*a* of cover member 31. Hydraulic passage 36 is connected to hydraulic pressure supply passage 60.

Accordingly, when the hydraulic pressure is acted to both of control hydraulic chambers 16 and 57, these hydraulic pressures (the resultant force of these hydraulic pressures) is large. Consequently, the operation pressure for starting the pivot movement of cam ring 5 in the counterclockwise direction against the spring force of first coil spring 27 becomes low. On the other hand, when the hydraulic pressure is acted only to one of control hydraulic chambers 16 and 57, the operation pressure for starting the pivot movement of cam ring 5 in the counterclockwise direction against the spring force of first coil spring 27 becomes large.

In this embodiment, the variable displacement pump is set so that the first operation pressure becomes a characteristic of FIG. 8 when the hydraulic pressure is introduced into both of first hydraulic chamber 16 and second control hydraulic chamber 57, and so that the first operation pressure becomes c characteristic of FIG. 8 when the hydraulic pressure is introduced into only first control hydraulic chamber 16.

In the initial state at the engine start shown in FIG. 11, the lower end portion of small diameter coil spring 27*b* of first coil spring 27 is elastically abutted on bottom surface 24*a* of spring receiving chamber 24, and the upper end portion of small diameter coil spring 27*b* of first coil spring 27 is elastically abutted on raised portion 23*b* of arm 23, so that small diameter coil spring 27*b* of first coil spring 27 is disposed to have the predetermined spring load. On the other hand, the lower end portion of large diameter coil spring 27*b* of first coil spring 27 is elastically s abutted on bottom surface 24*a* of spring receiving chamber 24, and the upper end portion of large diameter coil spring 27*b* is elastically abutted on retaining portions 61 and 61, so that large diameter coil spring 27*b* of first coil spring 27 is disposed to have the predetermined spring load.

Beside, cam ring 5 does not include the pivot pin. Cam ring 5 includes a pivot portion 5*b* which is formed into an arc protrusion shape, and which is swingably held in a pivot groove 62 formed in the inner circumference surface of pump housing 1.

Figure 13:
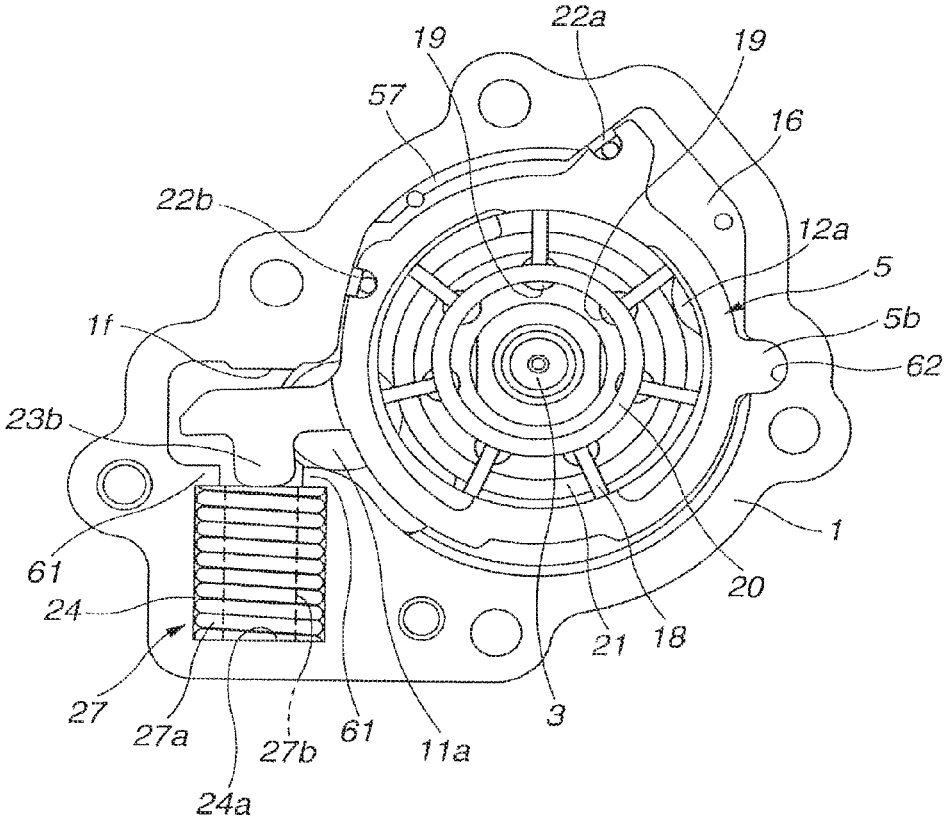
FIG. 13 is a view for illustrating an operation of the pump body of the variable displacement pump of FIG. 11.
Figure 14:
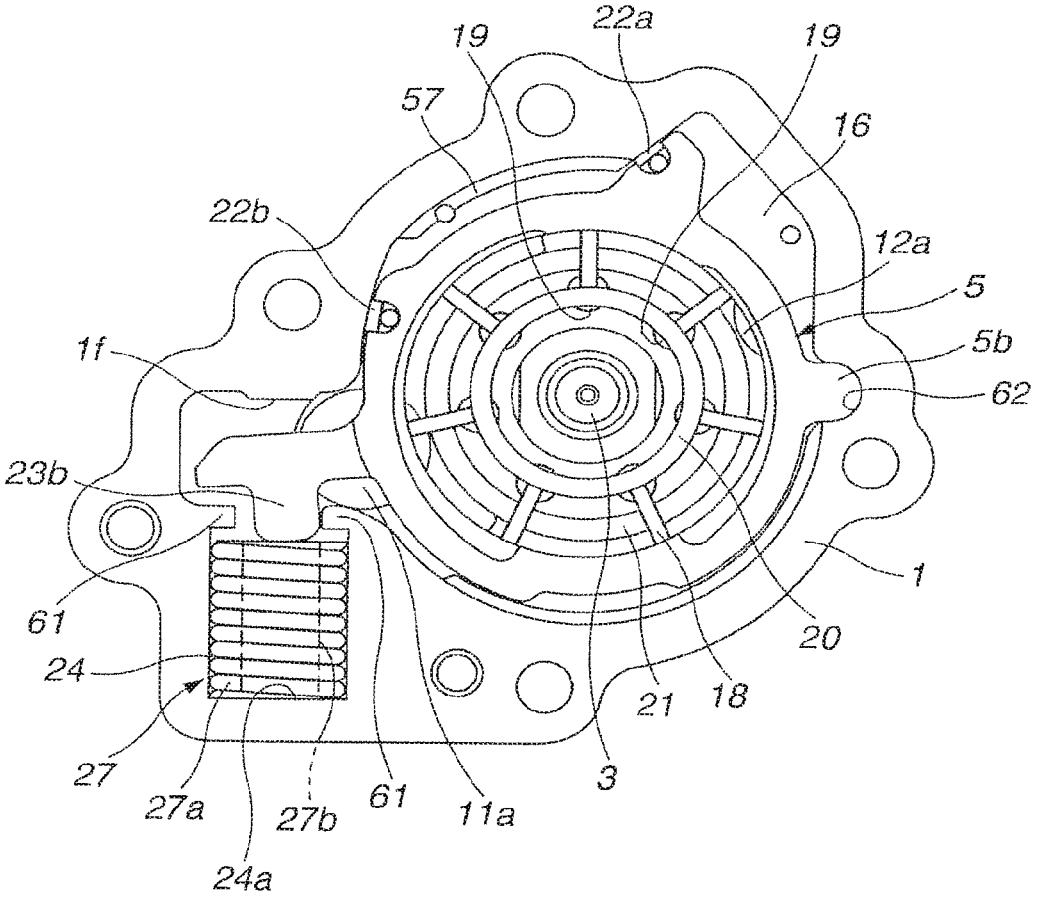
FIG. 14 is a view for illustrating an operation of the pump body of the variable displacement pump of FIG. 11.

Raised portion 23*b* of arm 23 has a width smaller than a width of an opening of the stopper between both retaining portions 61 and 61 as viewed from a front side. On the other hand, raised portion 23*b* of arm 23 has an axial length longer than an outside diameter of large diameter coil spring 24*a*. Accordingly, when the hydraulic pressure is acted to first control hydraulic chamber 16 and second control hydraulic chamber 57 and cam ring 5 is pivoted in the counterclockwise direction, raised portion 23*b* of arm 23 compresses only small diameter coil spring 27*b* at the initial stage of the movement. However, when raised portion 23*b* enters the opening portion of retaining portions 61 and 61, raised portion 23*b* of arm 23 is abutted on the upper end of large diameter coil spring 27*a* as shown in FIG. 13. Large diameter coil spring 27*a* has a spring load. Accordingly, the relationship between the displacement of cam ring 5 and the spring load becomes the state shown in FIG. 7, similarly to the first embodiment. Moreover, when the hydraulic pressures of control hydraulic chambers 16 and 57 become high so that the hydraulic pressure force becomes large, cam ring 5 is maximally pivoted in the counterclockwise direction against the resultant force of the spring forces of the both coil springs 27*a* and 27*b* of first coil spring 27, so that the oil pump becomes the state shown in FIG. 14.

Then, the hydraulic pressure characteristic when the same hydraulic pressure is acted to control hydraulic pressure chambers 16 and 57 becomes the characteristic shown by the solid line shown in FIG. 8, similarly to the first embodiment.

Functions of Third Embodiment

Next, functions of the present embodiment is illustrated with reference to the hydraulic pressure characteristic of FIG. 8.

As described above, FIG. 11 shows the initial state in which the engine speed is low and the hydraulic pressure is low. The pump main body is in the state of FIG. 11. Arm 23 is pressed on the stopper surface 1*g* which is positioned at the upper position of spring receiving chamber 24, by the spring force of first coil spring 27. That is, the eccentric amount is maximum, so that the variable displacement pump is the state of the maximum discharge amount.

In electromagnetic switching valve 8, push rod 47 is returned in the rearward direction by the return spring within solenoid portion 44 since the control unit outputs the OFF signal and electromagnetic switching valve 8 becomes the deenergized state. With this, ball valve 43 is pressed by the hydraulic pressure of first branch passage 29, so that second branch passage 29 and hydraulic passage 36 are connected through connection port 45. The hydraulic pressure of main oil gallery 13 is acted to the both of first control hydraulic chamber 16 and second control hydraulic chamber 57 since hydraulic passage 36 is connected to second control hydraulic chamber 57.

Accordingly, at the increase of the engine speed, the variable displacement pump becomes the hydraulic pressure characteristic shown by the solid line in FIG. 8. When the hydraulic pressure exceeds the first operation pressure a, cam ring 5 is moved in the counterclockwise direction to become the state of FIG. 13. When the hydraulic pressure exceeds the second operation pressure b, the variable displacement pump is shifted to the state shown in FIG. 14.

In this way, similarly to the first and second embodiments, in case of the minimum engine request, electromagnetic switching valve 8 is set to the deenergized state from the timing immediately after the engine start to the high engine speed. Accordingly, it is possible to set the electricity consumption to zero.

When the engine load becomes higher, the injection of the oil jet is needed even at the low engine speed. In this case, the ON signal is outputted to the electromagnetic coil of electromagnetic switching valve 8 to energize. With this, ball valve 43 closes solenoid opening port 42*a*, so that first branch passage 29 and hydraulic passage 36 is disconnected, and hydraulic passage 36 and drain port 46 are connected. With this, the hydraulic pressure of second control hydraulic chamber 57 is discharged to the outside through hydraulic passage 36, cylindrical passage 48, drain port 46, drain passage 38, sliding hole 30, and drain hole 31*a*.

As shown in FIG. 11, valve element 58 of pilot valve 7 is pressed on seat surface 59*b* by the spring force of valve spring 33. Valve element 58 closes opening 60*a* of hydraulic pressure supply passage 60, and opens opening 38*a* of drain port 38. Drain port 46 of electromagnetic switching valve 8 and drain passage 38 of pilot valve 7 are connected with each other. Second control hydraulic chamber 57 is disconnected from main oil gallery 13.

With this, the hydraulic pressure of second control hydraulic pressure chamber 57 is decreased, cam ring 5 is pivoted in the clockwise direction by the spring forces of both coil springs 27*a* and 27*b* so that the eccentric amount of cam ring 5 becomes large. With this, the hydraulic pressure of main oil gallery 13 is increased, similarly to the first and second embodiments.

The operation of cam ring 5 is identical to the operation in the above-described OFF state (the deenergized state) of electromagnetic switching valve 8. However, the operation hydraulic pressure is increased since the hydraulic pressure force of second control hydraulic chamber 57 is decreased. Accordingly, the hydraulic pressure characteristic becomes the characteristic shown by the short dot line of FIG. 8. The pressure receiving area of second control hydraulic chamber 57 is set so that first operation pressure c at this time becomes higher than a request hydraulic pressure (2) so as to surely perform the oil jet injection.

However, in the hydraulic pressure characteristic shown by the short dot line of FIG. 8, the hydraulic pressure is excessive. Accordingly, there may be generated the problems such as the friction increase, and the breakage of the other components. Therefore, it is necessary to control the hydraulic pressure.

When the hydraulic pressure of opening end 59*a* of second branch passage 59 becomes high, valve element 58 of pilot valve 7 is started to be moved in the downward direction against the spring force of valve spring 33. When the hydraulic pressure reaches the switching hydraulic pressure e shown in FIG. 8, pilot valve 7 becomes the state shown in FIG. 12. That is, only one of hydraulic pressure supply passage 60 and drain passage 38 is opened. Accordingly, when drain passage 38 is closed, second branch passage 59 and hydraulic pressure supply passage 60 are connected with each other.

Accordingly, the hydraulic pressure of main oil gallery 13 is supplied through hydraulic pressure supply passage 60 to second control hydraulic chamber 57.

The hydraulic pressure is introduced into second control hydraulic chamber 57. Accordingly, cam ring 5 is started to be pivoted in the counterclockwise direction by a hydraulic pressure lower than the hydraulic pressure when the hydraulic pressure is introduced only to first control hydraulic chamber 16.

When the hydraulic pressure of second control hydraulic chamber 57 is excessively high, the pivot movement amount of cam ring 5 in the counterclockwise direction becomes large, so that the discharge amount is decreased. In this case, the discharge pressure to main oil gallery 13 becomes low. With this, valve element 58 is moved in the upward direction by the spring force of valve spring 33, so that the opening area of the connection of opening end 60*a* of hydraulic pressure supply passage 60 becomes small. Consequently, the pressure loss at the introduction of the hydraulic pressure becomes large, so that the hydraulic pressure of second control hydraulic chamber 57 is decreased.

When the hydraulic pressure of second control hydraulic chamber 57 is excessively low, the pivot movement amount of cam ring 5 is small, so that the discharge amount becomes excessive. Accordingly, the discharge pressure to main oil gallery 13 becomes high. Consequently, valve element 58 is moved in the downward direction against the spring force of valve spring 33, so that the opening area of the connection of opening end 60*a* of hydraulic pressure supply passage 60 becomes large. Therefore, the pressure loss at the introduction of the hydraulic pressure is decreased, so that the hydraulic pressure of second control hydraulic chamber 57 is increased.

In this way, when the hydraulic pressure becomes the predetermined hydraulic pressure e shown in FIG. 8, valve element 58 closes drain passage 38, and second branch passage 59 and hydraulic pressure supply passage 60 are started to be connected with each other. Then, the hydraulic pressure of second control hydraulic chamber 57 is controlled by the variation of the opening area of the connection. Moreover, it is possible to control by the small movement distance of valve element 58. Accordingly, it is little-influenced by the spring constant of valve spring 33.

With this, it is possible to sufficiently vary the opening area of the connection by small variation of the hydraulic pressure. Accordingly, the hydraulic pressure is not increased even when the engine speed is increased, as shown by the long dot line in FIG. 8. It is possible to control to the substantially constant pressure e.

In a state in which hydraulic pressure supply passage 60 and drain passage 38 are fully connected with each other through electromagnetic switching valve 8, the hydraulic pressure is not acted to second control hydraulic chamber 57. Accordingly, electromagnetic switching valve 8 becomes the state identical to the deenergized state. Consequently, the hydraulic pressure characteristic becomes identical to the state shown by the solid line of FIG. 8.

As described above, only one of hydraulic pressure supply passage 60 and drain passage 38 is opened. However, to be exact, there may be a slight range in which both of hydraulic pressure supply passage 60 and drain passage 38 are opened, or neither of hydraulic pressure supply passage 60 and drain passage 38 are opened. Moreover, it is possible to chamfer corners of outer circumference edges of the upper and lower end edges of valve element 58, or to shape the outer circumference edges or the upper and lower end edges of valve element 58 into a curved shape (R-shape). Alternatively, it is possible to chamfer the corner of the outer circumference edges of one of the upper and lower end edges of valve element 58, or to shape the outer circumference edge of one of the upper and lower end edges of valve element 58 into the curved shape (the R-shape). There is the minute clearance between valve element 58 and sliding hole 30. Accordingly, the three ways (directions) are not fully closed. The above-described control operation varies the relationship between the displacement of valve element 58 and the variation of the opening area of the connection. It is appropriately selected and used in accordance with the specifications of the pump main body and the operation pressure.

As described above, in the variable displacement pump according to this embodiment, it is possible to obtain the two stepped hydraulic pressure characteristics in which the hydraulic pressure at the low engine speed is decreased while suppressing the electricity consumption by deenergizing electromagnetic switching valve 8. Moreover, it is possible to increase only the hydraulic pressure at the low engine speed in accordance with the request of the engine.

As the setting for maximally attaining this effect, the switching pressure e of pilot valve 7 is set larger than the valve opening pressure (2) of the oil jet, and equal to or smaller than the second operation pressure b. With this, even at the energized state, the hydraulic pressure does not exceed the maximum hydraulic pressure at the deenergized state of electromagnetic switching valve 8. Accordingly, it is possible to suppress the increase of the friction due to the unnecessary increase of the hydraulic pressure.

Moreover, at the increase of the engine speed, the timing at which electromagnetic switching valve 8 is switched from the ON state to the OFF state is set to the timing after the hydraulic pressure exceeds the second operation pressure b, or after the engine speed at which the hydraulic pressure reaches the second operation pressure. With this, at the engine speed at which the injection of the oil jet is needed, it is possible to prevent the injection of the oil jet from stopping due to the deficiency of the hydraulic pressure by the switching of electromagnetic switching valve 8 to the OFF state.

As described above, in the variable displacement pump according to the third embodiment, it is possible to attain the same effects as the first embodiment. Moreover, in the variable displacement pump according to the third embodiment, when the hydraulic pressure supply to second control hydraulic chamber 57 is shut off, the pump discharge pressure can be increased to the high pressure. Accordingly, it is possible to obtain the fail-safe effect by which the pressure becomes the high pressure at the clogging of the passage.

Moreover, in the variable displacement pump according to the third embodiment, the disposition of control hydraulic chambers 16 and 57, the structure and the disposition of first coil spring 27, and the shape of cam ring 5 according to the variation of control hydraulic chambers 16 and 57 and the variation of first coil spring 27 are varied relative to the variable displacement pump according to the first embodiment. However, the disposition of the coil spring in the variable displacement pump according to the third embodiment may be applied to the variable displacement pump according to the first embodiment. Conversely, the disposition of the coil spring in the variable displacement pump according to the first embodiment may be applied to the variable displacement pump according to the variable displacement pump according to the third embodiment.

[a] In the variable displacement pump according to the embodiments of the present invention, the control valve is arranged to decrease an area of a connection from the discharge portion to the second control chamber, and to increase an area of a connection from the second control chamber to the low pressure portion, by receiving the discharge pressure of the discharge portion.

[b] In the variable displacement pump according to the embodiments of the present invention, the second control chamber and the low pressure portion are disconnected when the control valve does not receive the discharge pressure of the discharge portion.

[c] In the variable displacement pump according to the embodiments of the present invention, the discharge portion and the second control chamber are disconnected when the control valve is maximally actuated.

[d] In the variable displacement pump according to the embodiments of the present invention, the electromagnetic switching valve is switched to the deenergized state after the control valve is actuated so that the pressure within the second control chamber becomes identical to the pressure of the low pressure portion.

[e] In the variable displacement pump according to the embodiments of the present invention, the pressure at which the control valve is started to be actuated is smaller than the discharge pressure of the discharge portion when the discharge pressure of the discharge portion is acted only to the first control chamber, the eccentric amount between the center of the rotation of the rotor and a center of an inner circumference surface of the cam ring becomes equal to or smaller than a predetermined amount, the urging force of the urging mechanism is stepwisely increased, and the cam ring is started to be moved against the increased urging force. [f] In the variable displacement pump according to the embodiments of the present invention, the control valve is actuated when the pressure of the discharge portion becomes equal to or greater than a predetermined pressure in a state in which the discharge pressure of the discharge portion is introduced into both of the first control chamber and the second control chamber, and the eccentric amount between the center of the rotation of the rotor and a center of an inner circumference surface of the cam ring becomes maximum.

[g] In the variable displacement pump according to the embodiments of the present invention, the variable displacement pump further comprises an orifice which is disposed between the electromagnetic switching valve and the second control chamber; and the control valve is arranged to open the pressure of the throttling and the second control chamber to the low pressure portion in accordance with the discharge pressure of the discharge portion.

[h] In the variable displacement pump according to the embodiments of the present invention, the one of the two spring members of the urging mechanism is arranged to apply a force in a direction in which the eccentric amount between the center of the rotation of the rotor and a center of an inner circumference surface of the cam ring is increased, to the cam ring; and the other of the two spring members of the urging mechanism is arranged to apply a force in a direction in which the eccentric amount between the center of the rotation of the rotor and the center of the inner circumference surface of the cam ring is decreased.

[i] In the variable displacement pump according to the embodiments of the present invention, the first control chamber and the second control chamber are disposed radially outside the cam ring.

[j] In the variable displacement pump according to the embodiments of the present invention, the control valve includes a pressure receiving portion which is disposed at one end portion of the control valve, and which receives the pressure from the discharge portion, and a spool valve which is slidably disposed within a sliding hole of the control valve at the other end portion of the control valve which is held to the low pressure, and which receives the urging force of the urging member; the control valve includes a one end opening of a first port which is formed at the one end portion of the sliding hole, and which is connected to the second control chamber, and a one end opening of a second port which is formed at the other end portion of the sliding hole, and which is connected through electromagnetic switching valve 8 to the second control chamber; and the control valve is arranged to increase an opening area of the one end opening of the first port and to decrease the opening area of the one end opening of the second port when the spool valve is moved by a predetermined distance or more against the urging force of the urging member.

[k] In the variable displacement pump according to the embodiments of the present invention, the one end opening of the second port is closed when the one end opening of the first port is opened.

The entire contents of Japanese Patent Application No. 2012-196713 filed Sep. 7, 2012 are incorporated herein by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable displacement oil pump provided to an internal combustion engine, the variable displacement oil pump comprising:

a housing including a pump receiving chamber formed within the housing;

a pump constituting section movably received within the pump receiving chamber, and arranged to be driven and rotated by the internal combustion engine, and thereby to discharge a hydraulic fluid sucked from a suction portion, an amount of the hydraulic fluid discharged from a discharge portion being varied in accordance with a position of the pump constituting section within the pump receiving chamber;

an urging member provided within the housing, provided with a spring load, and arranged to urge the pump constituting section in a direction where the amount of the hydraulic fluid discharged from the discharge portion is increased;

a first control hydraulic chamber formed between the pump constituting section and the pump receiving chamber, and arranged to receive the hydraulic fluid discharged from the discharge portion, a volume of the first control hydraulic chamber being increased when the pump constituting section is moved in a direction where the amount of the hydraulic fluid discharged from the discharge portion is decreased;

a second control hydraulic chamber formed between the pump constituting section and the pump receiving chamber, and arranged to receive the hydraulic fluid discharged from the discharge portion, a volume of the second control hydraulic chamber being increased when the pump constituting section is moved in the direction where the amount of the hydraulic fluid discharged from the discharge portion is increased;

a control valve including;

a control housing including a sliding hole formed within the control housing, a first opening portion opened to the sliding hole, and connected to the discharge portion, a second opening portion opened to the sliding hole, and connected to the second control hydraulic chamber, a third opening portion opened to the sliding hole, and connected to an outside, a spool valve which is disposed within the sliding hole, which is arranged to be urged in one direction by the hydraulic fluid discharged from the discharge portion, and introduced from the first opening portion, and which includes a passage formed within the spool valve, and arranged to connect the first opening portion and the second opening portion, and a spring arranged to urge the spool valve in an other direction opposite to the one direction, the first opening portion and the second opening portion being connected with each other through the passage when a pressure of the hydraulic fluid discharged from the discharge portion, and introduced into the first opening portion is smaller than a predetermined pressure, the second opening portion and the third opening portion being connected with each other when the pressure of the hydraulic fluid discharged from the discharge portion, and introduced into the first opening portion is equal to or greater than the predetermined pressure, an electromagnetic valve connected through the control valve to the second control hydraulic chamber, and arranged to switch a first state where the second control hydraulic chamber and a low pressure portion is disconnected, and a second state where the second control hydraulic chamber and the low pressure portion are connected, by an electric control from the outside.

2. The variable displacement pump as claimed in claim 1, wherein the pump constituting section includes a rotor driven and rotated by the internal combustion engine, a plurality of vanes which are provided on an outer circumference portion of the rotor to be projectable from and retractable in the rotor, and a movable member accommodating the rotor and the vanes therein to form a plurality of hydraulic fluid chambers, and arranged to be moved within the pump receiving chamber to vary an eccentric amount of an inner circumference of the movable member with respect to a center of the rotation of the rotor.

* * * * *